US009284794B2

(12) United States Patent
Dale et al.

(10) Patent No.: US 9,284,794 B2
(45) Date of Patent: Mar. 15, 2016

(54) SYSTEMS AND METHODS FOR ADVANCED WELL ACCESS TO SUBTERRANEAN FORMATIONS

(75) Inventors: Bruce A. Dale, Sugar Land, TX (US); Pavlin B. Entchev, Moscow (RU); Stuart R. Keller, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 300 days.

(21) Appl. No.: 13/991,855

(22) PCT Filed: Nov. 11, 2011

(86) PCT No.: PCT/US2011/060403

§ 371 (c)(1), (2), (4) Date: Jun. 5, 2013

(87) PCT Pub. No.: WO2012/106020

PCT Pub. Date: Aug. 9, 2012

(65) Prior Publication Data

US 2013/0299164 A1 Nov. 14, 2013

Related U.S. Application Data

(60) Provisional application No. 61/438,099, filed on Jan. 31, 2011.

(51) Int. Cl.

| | |
|---|---|
| ***E21B 17/18*** | (2006.01) |
| ***E21B 21/12*** | (2006.01) |
| ***E21B 43/12*** | (2006.01) |
| ***E21B 21/00*** | (2006.01) |
| ***E21B 34/06*** | (2006.01) |
| ***E21B 47/00*** | (2012.01) |

(52) U.S. Cl.

CPC ..... *E21B 17/18* (2013.01); *E21B 21/00* (2013.01); *E21B 21/12* (2013.01); *E21B 34/06* (2013.01); *E21B 43/12* (2013.01); *E21B 47/00* (2013.01)

(58) Field of Classification Search

CPC ..... E21B 43/12; E21B 34/06; E21B 21/00; E21B 47/00; E21B 21/12; E21B 17/003; E21B 43/127

See application file for complete search history.

(56) References Cited

U.S. PATENT DOCUMENTS

| | | | | |
|---|---|---|---|---|
| 4,332,509 | A | 6/1982 | Reynard et al. | |
| 4,422,508 | A * | 12/1983 | Rutledge, Jr. ..... | E21B 43/127 166/376 |
| 4,836,305 | A * | 6/1989 | Curlett ..... | E21B 17/003 175/215 |
| 5,664,628 | A | 9/1997 | Koehler et al. | |
| 5,803,179 | A | 9/1998 | Echols et al. | |

(Continued)

*Primary Examiner* — Yong-Suk (Philip) Ro

(74) *Attorney, Agent, or Firm* — ExxonMobil Upstream Research-Law Department

(57) ABSTRACT

Systems and methods for improving functional access to subterranean formations that include a well, which includes a casing string having at least one casing conduit that extends and provides a hydraulic connection between a surface region and the subterranean formation. Performing a plurality of downhole operations utilizing a casing string that constitutes a plurality of hydraulic pathways between the surface region and the subterranean formation. The plurality of downhole operations may be simultaneous operations and/or may be associated with at least one of a plurality of operational states including a drilling state, completing state, stimulating state, producing state, abandoning state, and/or killing state. In some embodiments, systems and methods may include a plurality of production control assemblies to control and/or monitor the downhole operations.

41 Claims, 11 Drawing Sheets

(56) References Cited

U.S. PATENT DOCUMENTS

| | | | |
|---|---|---|---|
| 5,881,809 | A | 3/1999 | Gillespie et al. |
| 6,070,663 | A | 6/2000 | Cernocky et al. |
| 6,405,800 | B1 | 6/2002 | Walker et al. |
| 6,494,265 | B2 | 12/2002 | Wilson et al. |
| 6,557,634 | B2 | 5/2003 | Hailey, Jr. et al. |
| 6,675,245 | B1 | 1/2004 | Schmidt |
| 6,848,510 | B2 | 2/2005 | Bixenman et al. |
| 7,735,559 | B2 | 6/2010 | Malone |
| 2004/0149471 | A1 | 8/2004 | Hall et al. |
| 2007/0114020 | A1 | 5/2007 | Brekke |
| 2009/0159279 | A1 | 6/2009 | Assal |
| 2009/0159298 | A1 | 6/2009 | Assal |
| 2010/0126729 | A1 | 5/2010 | Tunget |
| 2010/0247345 | A1 | 9/2010 | Morris |

* cited by examiner

SYSTEMS AND METHODS FOR ADVANCED WELL ACCESS TO SUBTERRANEAN FORMATIONS

CROSS REFERENCE TO RELATED APPLICATIONS

This application is the National Stage of International Application No. PCT/US2011/060403, filed Nov. 11, 2011, which claims the benefit of U.S. Provisional Application No. 61/438,099, filed Jan. 31, 2011, the entirety of which is incorporated herein by reference for all purposes.

FIELD OF THE DISCLOSURE

The present disclosure is related generally to systems and methods for improving well access to subterranean formations, and more particularly to such systems and methods that include a plurality of fluid communication pathways between a surface region and a subterranean formation as part of a single, or self-contained, casing conduit.

BACKGROUND OF THE DISCLOSURE

In general, a well is a structure that provides access, or communication, between a surface region and a subterranean formation. Illustrative, non-exclusive examples of access may include fluid access or fluid communication (or similarly hydraulic access or hydraulic communication), mechanical access or mechanical communication, data access or data communication, electrical access or electrical communication, and/or any suitable combination of these. Illustrative, non-exclusive examples of fluid access or fluid communication may include providing a stimulant fluid from the surface region to the subterranean formation and/or producing a reservoir fluid from the subterranean formation to the surface region. Illustrative, non-exclusive examples of mechanical access or mechanical communication may include supplying a drill bit or other mechanical equipment from the surface region to the subterranean formation and/or performing a drilling operation with the drill bit in the subterranean formation. Illustrative, non-exclusive examples of data access or data communication may include supplying well-monitoring equipment, such as temperature, pressure, chemical composition, and/or flow rate monitoring equipment from the surface region to the subterranean formation and/or monitoring a status of the well with the monitoring equipment. Illustrative, non-exclusive examples of electrical access or electrical communication may include communicating with the well-monitoring equipment discussed above, as well as supplying electrical current to a subsurface region and/or to one or more devices contained within the wellbore to, for instance, provide heat to at least a portion of the subsurface region.

Historically, access between the surface region and the subterranean formation has been accomplished using single point-of-entry, or mono-entry, wells. This type of well includes a single point-of-entry to drill the well, complete the well structure, produce fluids from the subterranean formation, provide fluids to the subterranean formation, service the well, and/or monitor the status of the well. While these mono-entry wells may include multiple fluid flow pathways or conduits below the surface region, all of these fluid flow pathways communicate with the surface region via the single point-of-entry.

Under certain circumstances, relying on a single point-of-entry for access between the surface region and the subterranean formation may be problematic, or at least inefficient. As an illustrative, non-exclusive example, a well may be damaged or subjected to conditions in which it experiences an uncontrolled flow of fluid from the well, which also may be called a blowout. Under these circumstances, the traditional, single point-of-entry well may not provide the level of access needed to stop the blowout, and other techniques may need to be utilized. This may include the drilling of a relief well that intersects the original well at a point in the subsurface region, which provides a second point-of-entry into the well, and which may provide the level of access needed to control the blowout and/or kill the well. As another illustrative, non-exclusive example, single point-of-entry wells may limit the rate at which the well may be drilled or completed, and/or may limit enhanced recovery and/or abandonment operations due to the limitations of having only the single point-of-entry, especially with respect to the terminal depth(s) of the well's casing.

Thus, there exists a need for systems and methods to provide improved well access between the surface region and the subterranean formation.

SUMMARY OF THE DISCLOSURE

The present disclosure is directed to systems and methods for improving functional access between surface regions and corresponding subterranean formations that are in at least fluid communication therewith via a well. The systems and methods may include the use of a casing string that extends within the well and which constitutes a plurality of hydraulic pathways between a surface region and the subterranean formation. The systems and methods further may include performing a plurality of downhole operations within the subterranean formation using the plurality of hydraulic pathways, and these plurality of downhole operations may include simultaneous downhole operations. In some embodiments, the downhole operations may include downhole operations affecting the distal, or terminal, regions (or depths) of the well and/or of a casing string of the well. The subterranean formation may include a hydrocarbon reservoir, such as an oil reservoir, and the systems and methods may include producing a hydrocarbon, such as oil, from the subterranean formation.

In some embodiments, the plurality of simultaneous downhole operations may be associated with at least one of a plurality of operational states of the well. Illustrative, non-exclusive examples of such operational (or operating) states include a drilling state, a completing state, a stimulating state, a producing state, an abandoning state, and/or a killing state. In some embodiments, the systems and methods further may include, and/or may include the use of, a plurality of production control assemblies to control and/or monitor the plurality of downhole operations. In some embodiments, the casing string further may include one or more data access pathways and/or mechanical access pathways, and the systems and methods may include performing one or more data collection and/or mechanical operations within the well.

The systems and methods disclosed herein may decrease the costs and/or environmental impacts associated with well operation and/or improve the overall efficiency of the various operational states associated with the well. Although not required to all such systems and methods, this may include easing seasonal operational constraints; improving emergency deployment operations and/or decreasing emergency response times; facilitating low-cost, efficient plugging, abandonment, and/or killing operations; and/or facilitate advanced oil recovery techniques.

DETAILED DESCRIPTION AND BEST MODE OF THE DISCLOSURE

Figure 1:
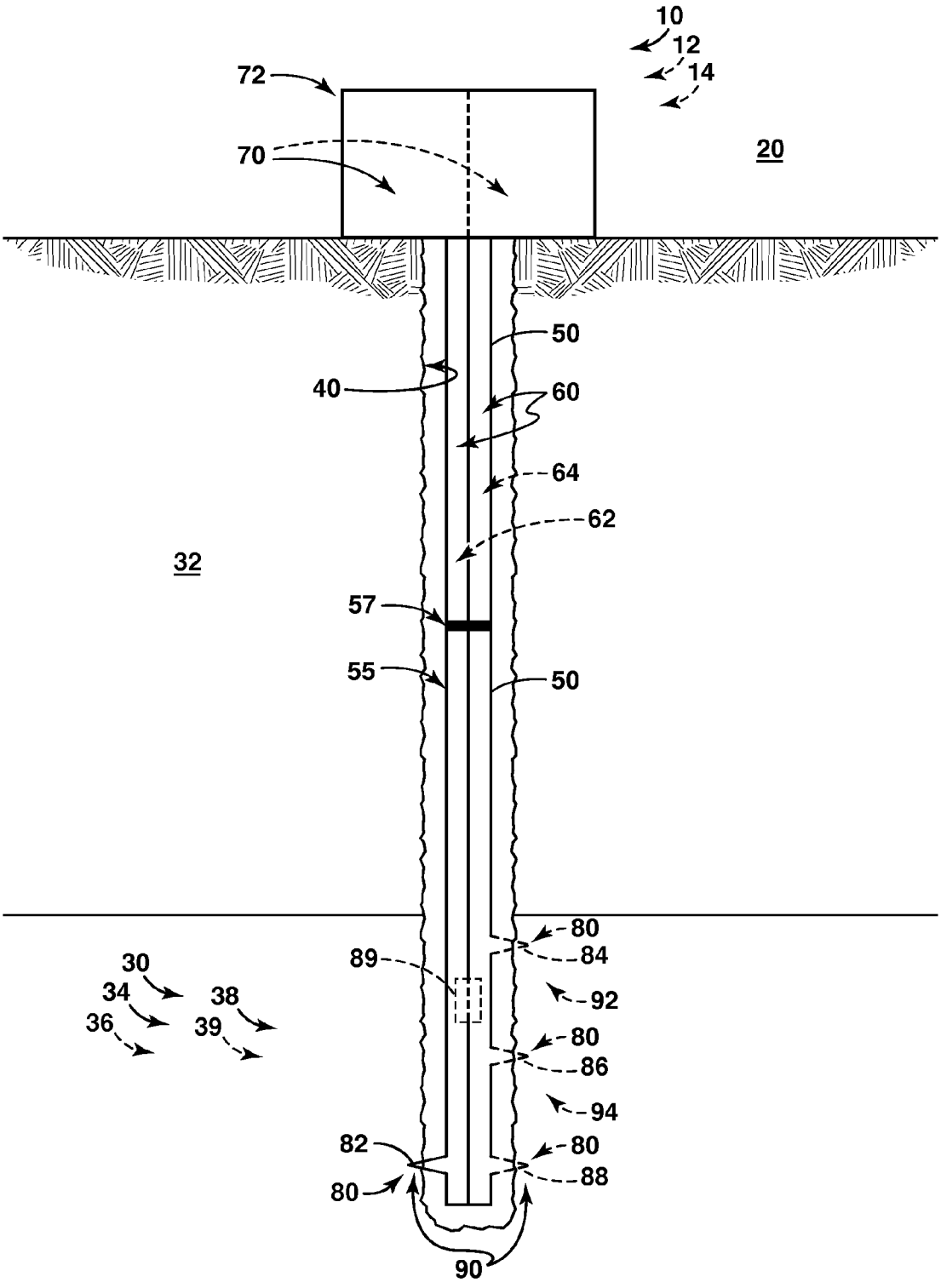
FIG. 1 is schematic representation of an illustrative, non-exclusive example of an oil well including two production control assemblies and a casing string forming two hydraulic pathways according to the present disclosure.

FIG. 1 provides an illustrative, non-exclusive example of a well 10 according to the present disclosure. The well, which may include a hydrocarbon well 12, an oil well 14, or any other suitable well structure, provides a hydraulic connection between a surface region 20 and a subterranean formation 30 contained within a subsurface region 32. The term "oil well" as used herein is defined broadly to include substantially any well or well that may be useful towards the production of hydrocarbons, such as an oil well, gas well, fluid injection well, monitoring well, exploration well, geothermal well, or other such wellbore. Subterranean formation 30 also may be referred to as, and/or as containing or including, a reservoir 34 that contains reservoir fluid 38. When the reservoir fluid includes oil or another hydrocarbon 39, the reservoir may be referred to as an oil reservoir or a hydrocarbon reservoir 36.

Well 10 includes a wellbore 40 that provides access between the surface region and the subterranean formation, such as for the transfer of fluid, equipment, data, and the like therebetween. Wellbore 40 additionally or alternatively may be referred to as a bore hole, as it represents the passage, or opening, in the ground into which casing strings, production strings, and the like may be inserted. A casing string 55 extends within the wellbore and constitutes or otherwise provides a plurality of hydraulic pathways 60, including at least a first hydraulic pathway 62 and a second hydraulic pathway 64, between the surface region and the subterranean formation. The hydraulic pathways may provide a conduit for the movement of fluids, solids, particulates, monitoring equipment, and/or mechanical equipment into and/or out of the well through the wellbore via the casing string. As illustrated, the plurality of hydraulic pathways 60 may be in fluid communication with one or more production control assemblies 70 that may be configured to monitor and/or control the flow of fluid therethrough.

Each of the plurality of hydraulic pathways may further include one or more subterranean communication points 80 that permit, enable, and/or otherwise provide for fluid communication to and/or from the hydraulic pathways. Subterranean communication points 80 may additionally or alternatively be referred to herein as subterranean communication ports, subterranean communication regions, and/or subterranean perforations, and/or subterranean communication zones. As illustrated, FIG. 1 schematically depicts four subterranean communication points 82, 84, 86, and 88, although it is within the scope of the present disclosure that the number, size, relative and actual position, etc. of subterranean communication points may vary, including having less than four such points or more than four such points. The subterranean communication points may provide fluid communication between the surface region and various portions of the subterranean formation via any suitable mechanism or structure, including apertures, perforations, flow control devices, and the like. In the schematic example of FIG. 1, the subterranean communication points are depicted as providing for fluid communication with a first portion 90 of subterranean formation 30, a second portion 92 of the subterranean formation, and a third portion 94 of the subterranean formation. However, similar to the number and type of subterranean communication points being variable within the scope of the present disclosure, so too are the number of portions of a subterranean formation with which fluid communication is established or otherwise provided by the subterranean communication points of a particular plurality of hydraulic pathways 60 and/or casing string 55.

Production control assemblies 70 may include any suitable structure adapted to control the transport of fluid, information, and/or physical equipment into and/or out of the well and may include separate production control assemblies 70 and/or integrated production control structures 72 that include one or more production control assemblies. Thus, and as shown in FIG. 1, it is within the scope of the present disclosure that each of the plurality of hydraulic pathways of well 10 may be in communication with a separate production control assembly 70 and/or that a portion of the plurality of hydraulic pathways may share a single production control assembly 70 and/or production control structure 72. Illustrative, non-exclusive examples of production control assemblies and/or production control structures according to the present disclosure include any suitable collection of valves, pipes, spools, blowout prevention devices, pumps, pressure relief devices, and/or fittings used to control the flow of fluid to and/or from the well. As illustrative, non-exclusive examples, production control assemblies according to the present disclosure may include one or more production tree (s), mechanical access port(s) adapted to provide mechanical access to at least one of the plurality of hydraulic pathways, chemical injection point(s) adapted to provide a fluid communication pathway for the injection of one or more chemicals into the subterranean well, and/or data access port(s) adapted to provide informational access to at least one of the plurality of hydraulic pathways.

Casing string 55 includes one or more casing conduits 50 that each include a longitudinal axis and are operatively attached along their respective longitudinal axes at casing conduit junction(s) 57 to form the casing string. As discussed in more detail herein, at least a portion of the one or more casing conduits 50 may form, comprise, and/or constitute a plurality of hydraulic pathways 60 that may be oriented generally parallel to the respective longitudinal axes of the casing conduits. When combined into a casing string, this plurality of hydraulic pathways then forms, comprises, and/or constitutes the plurality of hydraulic pathways between the surface region and the subterranean formation. As used herein, references to the casing conduits and/or the casing string forming, comprising, and/or constituting a plurality of hydraulic pathways include each of the plurality of hydraulic pathways being formed and/or defined solely by the structure of the casing conduit, casing conduit junction, and/or casing string. Thus, the casing conduit and/or the casing string forming, comprising, and/or constituting a plurality of hydraulic pathways includes these hydraulic pathways being defined by the structure of the casing string alone and not by another and/or an additional structure that may be associated with the casing string. Stated another way, each of the plurality of hydraulic pathways is completely contained within, is self-contained by, and/or forms a portion of the structure of at least the casing conduits that make up the casing string.

As an illustrative, non-exclusive example, the casing conduits 50 and/or casing string 55 of FIG. 1 fully define(s) each of first hydraulic pathway 62 and second hydraulic pathway 64 without the need for and/or use of additional structure, such as a second casing, conduit, or tube that may be placed within and/or proximal to casing conduit 50 and/or casing string 55. While, as discussed in more detail herein, casing conduit 50 and/or casing string 55 fully defines a plurality of hydraulic pathways that include at least first hydraulic pathway 62 and second hydraulic pathway 64 of FIG. 1, it is within the scope of the present disclosure that other and/or additional hydraulic pathways may exist within well 10 and/or wellbore 40, and that these hydraulic pathways may be formed and/or defined by casing conduit 50 and/or casing string 55 alone, by another suitable conduit or structure, and/or by a combination of casing conduit 50 and/or casing string 55 and another suitable structure. As an illustrative, non-exclusive example, while the casing string of FIG. 1 may define a plurality of hydraulic pathways 60 that includes at least first hydraulic pathway 62 and second hydraulic pathway 64, it is within the scope of the present disclosure that at least one of first hydraulic pathway 62 and second hydraulic pathway 64 may include or contain another suitable conduit adapted to provide at least a third hydraulic pathway that is not formed, defined, and/or constituted solely by and/or self-contained within, casing conduit 50 and/or casing string 55.

As shown in FIG. 1, it is within the scope of the present disclosure that one or more of the plurality of hydraulic pathways 60 may be in fluid communication with a portion of the subterranean formation through subterranean communication points 80 and/or another suitable structure. It is also within the scope of the present disclosure that one or more of the plurality of hydraulic pathways may be in fluid communication with one or more other ones of the plurality of hydraulic pathways, as schematically depicted by inter-pathway communication point 89. Thus, it is within the scope of the present disclosure that both first hydraulic pathway 62 and second hydraulic pathway 64 may be in fluid communication with the same portion of the subterranean formation, such as first portion 90 of the subterranean formation; that first hydraulic pathway 62 may be in fluid communication with first portion 90 of the subterranean formation, while second hydraulic pathway 64 is in fluid communication with another portion of the subterranean formation, such as second portion 92 and/or third portion 94; that at least one of the plurality of hydraulic pathways may be in fluid communication with more than one portion of the subterranean formation, such as second hydraulic pathway being in fluid communication with the first portion 90, the second portion 92, and/or the third portions 94 of the subterranean formation, respectively; and/or that first hydraulic pathway 62 may be in fluid communication with second hydraulic pathway 64 through one or more inter-pathway communication points 89.

Figure 2:
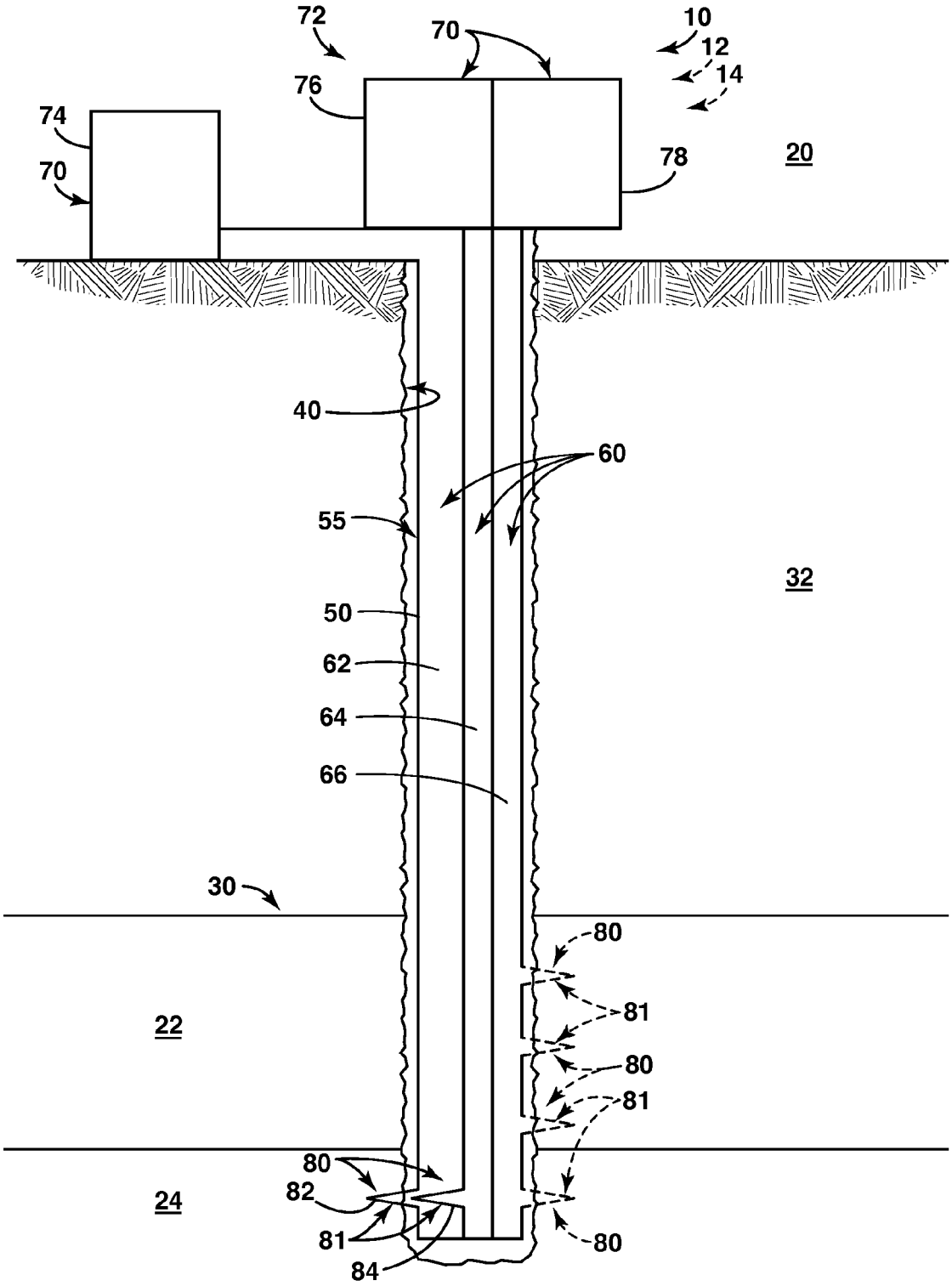
FIG. 2 is a schematic representation of an illustrative, non-exclusive example of an oil well including three production control assemblies and a casing string forming three hydraulic pathways according to the present disclosure.

FIG. 2 provides an illustrative, non-exclusive example of another well 10 according to the present disclosure that includes a plurality of production control assemblies 70 and a casing string 55 constituting a plurality of hydraulic pathways 60, which in the depicted example include three hydraulic pathways. Specifically, FIG. 2 depicts that the plurality of production control assemblies 70 includes first production control assembly 74, second production control assembly 76, and third production control assembly 78, and that the plurality of hydraulic pathways 60 include first hydraulic pathway 62, second hydraulic pathway 64, and third hydraulic pathway 66. As discussed, it is within the scope of the present disclosure that the relative and actual number of production control assemblies and hydraulic pathways may vary, such as to include more or less production control assemblies and/or hydraulic pathways than discussed in the illustrative, non-exclusive examples depicted herein.

In the illustrative, non-exclusive example of FIG. 2, each of the hydraulic pathways is associated with and/or in fluid communication with a separate production control assembly. It is within the scope of the present disclosure that the plurality of production control assemblies 70, when present, may be located together or in spaced-apart configurations even though the production control assemblies regulate fluid and/or other communication relative to the plurality of hydraulic pathways of casing string within a specific well. Accordingly, FIG. 2 provides a schematic graphical illustration that it is within the scope of the present disclosure that production control assemblies 70 may include integrated production control structures 72 that include two or more production control assemblies 70, such as second production control assembly 76 and third production control assembly 78.

In addition, FIG. 2 also graphically depicts that it is within the scope of the present disclosure that production control assemblies 70 may include separate, spaced-apart production control assemblies, such as first production control assembly 74. When production control assemblies 70 include spaced-apart production control assemblies, these production control assemblies may be separated by any suitable distance, illustrative, non-exclusive examples of which include distances of at least one meter, including distances of at least 10 meters, at least 25 meters, at least 50 meters, at least 100 meters, at least one kilometer, at least five kilometers, at least 10 kilometers, at least 20 kilometers, at least 25 kilometers, or at least 30 kilometers.

FIG. 2 further illustrates that subterranean formation 30 may (but is not required to) include a plurality of sub-formations, including first sub-formation 22 and/or second sub-formation 24, and that the sub-formations may be at different depths relative to surface region 20. It is within the scope of the present disclosure that each of the plurality of hydraulic pathways 60 may be in fluid communication with one or more sub-formations through subterranean communication points 80, and that this may include a single hydraulic pathway communicating with a plurality of depths within a single sub-formation, a single hydraulic pathway communicating with two or more different sub-formations, two hydraulic pathways communicating with the same sub-formation, and/or two hydraulic pathways communicating with different sub-formations. It is within the scope of the present disclosure that communicating with a plurality of depths either within a single formation or between sub-formations may include communicating with depths that differ by one meter or more, including depths that differ by at least five meters, at least 10 meters, at least 25 meters, at least 50 meters, or at least 100 meters.

Figure 3:
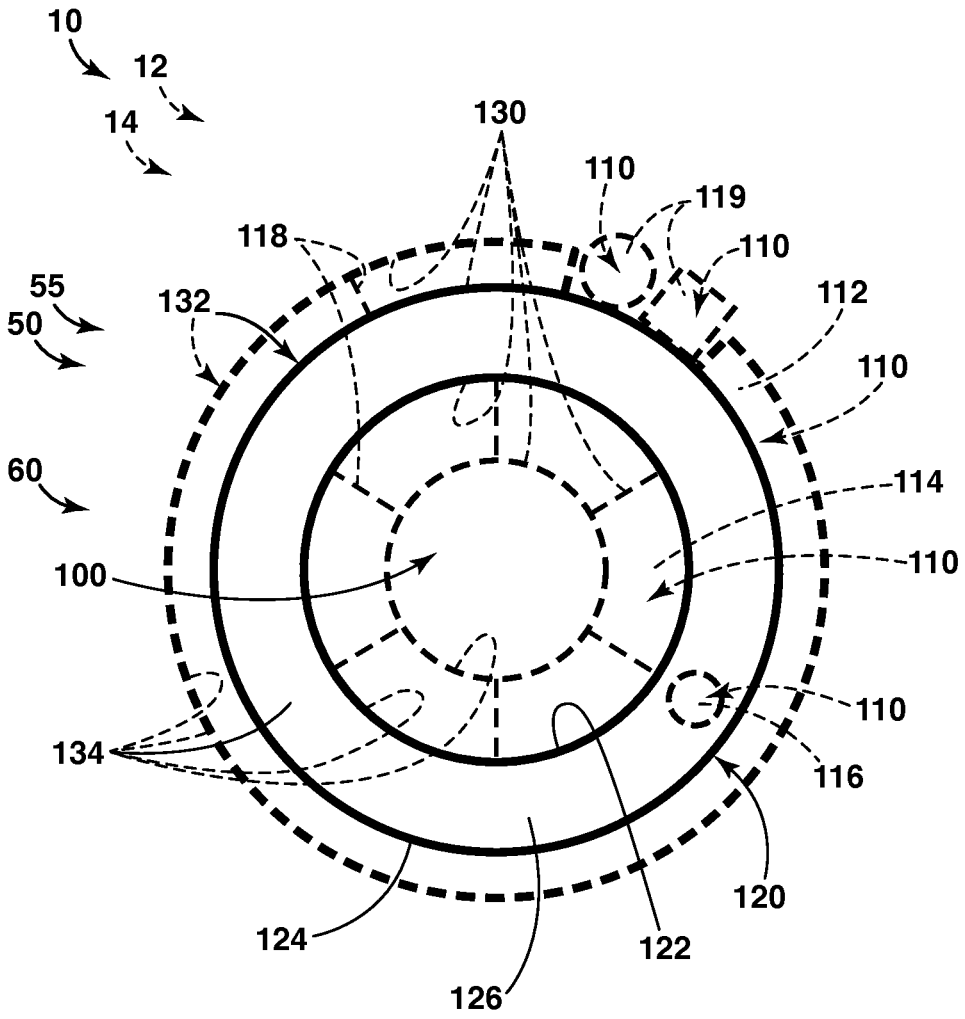
FIG. 3 is a schematic representation of a transverse cross-sectional view of an illustrative, non-exclusive example of a casing conduit according to the present disclosure, wherein the casing conduit includes a primary hydraulic pathway and one or more secondary hydraulic pathways on an inner basal conduit surface, an outer basal conduit surface, and/or internal to the basal conduit wall.

FIG. 3 is a schematic transverse cross-sectional view of an illustrative, non-exclusive example of a casing conduit 50 according to the present disclosure. As discussed, casing conduit 50 may form a portion of a casing string 55 and/or well 10 according to the present disclosure and/or which may be utilized with the systems and/or the methods disclosed herein. As also discussed in detail herein, casing conduit 50 includes a plurality of hydraulic pathways 60, including at least a first hydraulic pathway 100 and at least a second hydraulic pathway 110, which additionally or alternatively may be referred to as a primary hydraulic pathway 100 and at least a first secondary hydraulic pathway 110. Casing conduit 50 includes a basal conduit 120 that includes an inner basal conduit surface 122, and outer basal conduit surface 124, and a basal conduit wall 126 extending between the inner basal conduit surface and the outer basal conduit surface. In addition, casing conduit 50 includes a plurality of inner casing conduit surfaces 130, an outer casing conduit surface 132, and a plurality of casing conduit walls 134 separating the plurality of hydraulic pathways. As shown in FIG. 3, it is within the scope of the present disclosure that the (or at least one of the) secondary hydraulic pathway(s) may be located on and/or form a portion of the outer basal conduit wall, as indicated at 112 and 119, may be located on and/or form a portion of the inner basal conduit wall, as indicated at 114, and/or may be located within the basal conduit wall as indicated at 116. The basal conduit additionally or alternatively may be referred to as a primary conduit and/or a main conduit without departing from the scope of the present disclosure.

Outer casing conduit surface 132 includes the outer perimeter of casing conduit 50. When the casing conduit includes secondary hydraulic pathways that are located on and/or form a portion of the outer basal conduit wall, such as indicated at 112 and 119, outer casing conduit surface 132 includes an outer surface of the secondary hydraulic pathways. When the casing conduit does not include secondary hydraulic pathways that are located on and/or form a portion of the outer basal conduit wall, outer casing conduit surface 132 includes and/or is coextensive with outer basal conduit surface 124.

Inner casing conduit surfaces 130 include surfaces that are in direct fluid communication with at least a portion of the plurality hydraulic pathways contained within casing conduit 50. Since casing conduit 50 includes a plurality of hydraulic pathways, casing conduit 50 also includes a plurality of inner casing conduit surfaces 130, including at least one inner casing conduit surface for each of the plurality of hydraulic pathways. Outer casing conduit surface 132 forms a perimeter around, bounds, and/or surrounds each of the plurality of inner casing conduit surfaces. Each of the plurality of hydraulic pathways may be separated from each of the other hydraulic pathways and/or from the exterior environment of casing conduit 50 by one or more casing conduit walls 134 and/or basal conduit walls 126, as shown in FIG. 3.

It is within the scope of the present disclosure that casing conduit 50 may include and/or be formed as a monolithic structure that forms at least a portion of the plurality of hydraulic pathways. When casing conduit 50 includes a monolithic structure, that structure may be formed by any suitable method. Illustrative, non-exclusive examples of methods of forming a monolithic casing conduit according to the present disclosure include any suitable pipe and/or tubing fabrication method, such as welded and/or seamless pipe fabrication methods; extrusion; and/or suitable machining techniques. As an illustrative, non-exclusive example, casing conduit 50 may include secondary hydraulic pathway 110 that is located within the basal conduit wall, as shown at 116. When the casing conduit includes a monolithic structure that forms both primary hydraulic pathway 100 and the secondary hydraulic pathway shown at 116, both of these hydraulic pathways may be formed as a single structure and from a single material. It is within the scope of the present disclosure that a casing conduit 50 that includes a monolithic structure that defines the primary hydraulic pathway and the at least a first second hydraulic pathway may include the secondary hydraulic pathway(s) being located on any suitable portion of the casing conduit, as shown in FIG. 3. It is also within the scope of the present disclosure that primary hydraulic pathway 100 may be formed from a first monolithic structure; while at least a portion of secondary hydraulic pathway(s) 110 are formed from a second monolithic structure.

It is also within the scope of the present disclosure that casing conduit 50 may include and/or be formed as a composite structure that forms at least a portion of the plurality of hydraulic pathways. When casing conduit 50 includes a composite structure, at least a first basal conduit may be operatively attached to at least a first secondary conduit to form the composite casing conduit. The conduits may be operatively attached using any suitable method, illustrative, non-exclusive examples of which include an adhesive, an epoxy, a weld, a fixture, a fastener, a thread, and/or a clasp. It is within the scope of the present disclosure that at least one of the plurality of hydraulic pathways may include a discrete hydraulic conduit that is formed separately from the casing conduit and placed within the basal conduit wall during the basal conduit formation process. It is also within the scope of the present disclosure that a composite casing conduit structure may include one or more monolithic portions, or components.

As discussed in more detail herein, casing conduit 50 may include any suitable number of hydraulic pathways, including two or more hydraulic pathways, such as more than three hydraulic pathways, more than five hydraulic pathways, more than seven hydraulic pathways, more than 10 hydraulic pathways, more than 15 hydraulic pathways, more than 20 hydraulic pathways, etc. While only a single hydraulic pathway is shown within the basal conduit wall in FIG. 3, it is within the scope of the present disclosure that any suitable number of hydraulic pathways may be present within the basal conduit wall. Similarly, and as shown in FIG. 3, any suitable number of hydraulic pathways may be located on the inner and/or outer basal conduit wall. This may include hydraulic pathways that may be divided by internal walls 118 to form multiple hydraulic pathways, as well as separate, stand-alone hydraulic pathways 119.

The hydraulic pathways, including basal conduit 120, primary hydraulic pathway 100, and each of the at least a first secondary hydraulic pathways 110, also may include any suitable cross-sectional shape. Less schematic, but still illustrative, non-exclusive, examples of hydraulic pathway shapes and locations are shown in FIGS. 4-10. FIGS. 4-10 provide transverse cross-sectional views of illustrative casing conduits that include a primary hydraulic pathway 100 and at least a first secondary hydraulic pathway 110.

Figure 4:
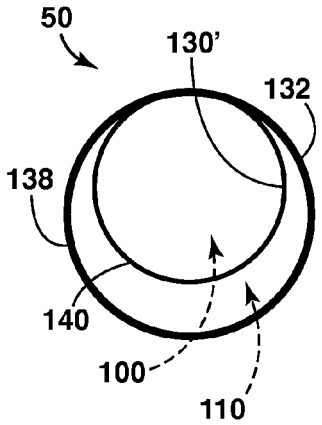
FIG. 4 is a schematic representation of a transverse cross-sectional view of an illustrative, non-exclusive example of a casing conduit according to the present disclosure, wherein the casing conduit includes a primary hydraulic pathway and a secondary hydraulic pathway.
Figure 5:
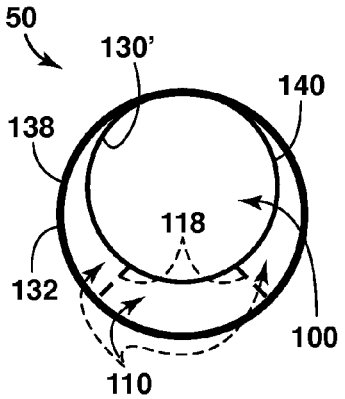
FIG. 5 is a schematic representation of a transverse cross-sectional view of an illustrative, non-exclusive example of a casing conduit according to the present disclosure, wherein the casing conduit includes a primary hydraulic pathway and a plurality of secondary hydraulic pathways.

In FIG. 4, a single, crescent-shaped secondary hydraulic pathway 110 is defined in the annular space between an outer casing conduit wall 138 and an inner casing conduit wall 140, with the outer casing conduit wall defining outer casing conduit surface 132 and the inner casing conduit wall defining inner casing conduit surface 130'. Primary hydraulic pathway 100 is defined within inner casing conduit wall 140. FIG. 5 is similar to FIG. 4, except that the crescent-shaped secondary hydraulic pathway has been divided into a plurality of secondary hydraulic pathways through the inclusion of internal walls 118 within the crescent-shaped annular space.

Figure 6:
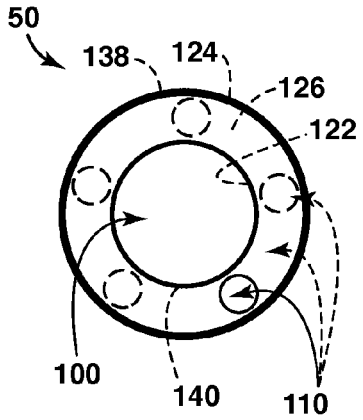
FIG. 6 is a schematic representation of a transverse cross-sectional view of an illustrative, non-exclusive example of a casing conduit according to the present disclosure, wherein the casing conduit includes a primary hydraulic pathway arranged concentrically within an outer conduit that further includes a plurality of secondary conduits forming a plurality of secondary hydraulic pathways arranged circumferentially about the primary hydraulic pathway.

In FIG. 6, primary hydraulic pathway 100 is surrounded by one or more circumferentially distributed secondary hydraulic pathways 110. It is within the scope of the present disclosure that the plurality of circumferentially distributed secondary hydraulic pathways may be formed within basal conduit wall 126, such as when the basal conduit wall is defined in the space between inner basal conduit surface 122 and outer basal conduit surface 124. However, it is also within the scope of the present disclosure that the plurality of secondary hydraulic pathways may be included in the annular space between outer casing conduit wall 138 and inner casing conduit wall 140. When the plurality of secondary hydraulic pathways are included in the annular space between outer casing conduit wall 138 and inner casing conduit wall 140, the annular space may itself form one or more of the plurality of hydraulic pathways.

Figure 7:
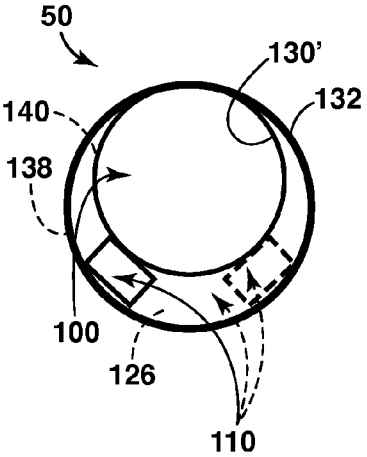
FIG. 7 is a schematic representation of a transverse cross-sectional view of an illustrative, non-exclusive example of a casing conduit according to the present disclosure, wherein the casing conduit includes a primary hydraulic pathway and a secondary hydraulic pathway that further includes a plurality of shunt conduits.
Figure 8:
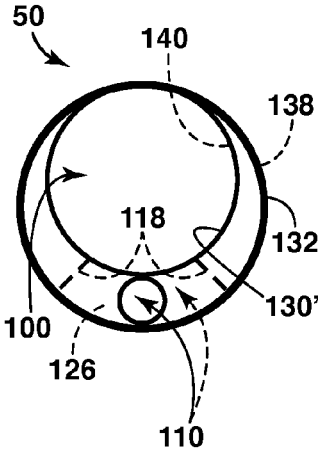
FIG. 8 is a schematic representation of a transverse cross-sectional view of an illustrative, non-exclusive example of a casing conduit according to the present disclosure, wherein the casing conduit includes a primary hydraulic pathway contained within a primary conduit and at least a first secondary hydraulic pathway contained within a secondary conduit, and further wherein the primary conduit and the secondary conduit are contained within an outer conduit.

FIGS. 7 and 8 illustrate primary hydraulic pathways 100 that are offset from the center of casing conduit 50 in a manner that is similar to that of FIGS. 4 and 5. However, in FIGS. 7 and 8, the crescent-shaped space between outer casing conduit surface 132 and inner casing conduit surface 130' may include one or more secondary conduits of any suitable cross-sectional shape, illustrative, non-exclusive examples of which include circular, square, rectangular, triangular, and/or ellipsoidal shapes that may be continuous along a length of the casing string and/or casing conduit and/or may serve as shunts between two or more locations along the length of the casing conduit and/or casing string. Similar to the casing conduit of FIG. 6, it is within the scope of the present disclosure that the plurality of secondary hydraulic pathways in the crescent-shaped space of FIGS. 7 and 8 may be contained within basal conduit wall 126. However, it is also within the scope of the present disclosure that the crescent-shaped space may be defined between outer casing conduit wall 138 and inner casing conduit wall 140 such that the crescent-shaped space forms at least one of the plurality of hydraulic pathways.

Figure 9:
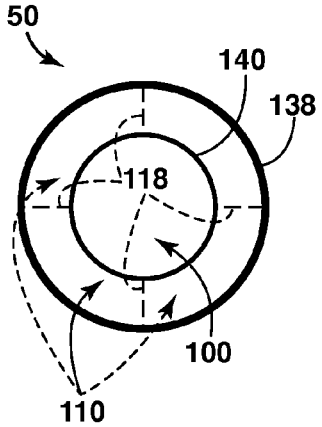
FIG. 9 is a schematic representation of a transverse cross-sectional view of an illustrative, non-exclusive example of a casing conduit according to the present disclosure, wherein the casing conduit includes a primary hydraulic pathway defined by a primary conduit and arranged concentrically within an outer conduit and a plurality of secondary hydraulic pathways defined in the annular space between the primary conduit and the outer conduit.

FIG. 9 illustrates a casing conduit configuration in which an annular space between outer casing conduit wall 138 and inner casing conduit wall 140 is divided into a plurality of secondary hydraulic pathways 110 through the presence of internal walls 118 that divide and/or segregate the annular space. The casing conduit configuration of FIG. 10 is substantially similar to that of FIG. 8, except that outer casing conduit wall 138 of FIG. 10 is depicted to be a fluid-permeable casing conduit wall 136.

While FIGS. 4-10 illustrate casing conduit configurations that include a specific number of hydraulic pathways, it is within the scope of the present disclosure that, as discussed in more detail herein, any suitable number of hydraulic pathways may be present in a particular casing conduit according to the present disclosure. As an illustrative, non-exclusive example, FIG. 9 shows the annular space between outer casing conduit wall 138 and inner casing conduit wall 140 being optionally divided into four secondary hydraulic pathways of approximately equal cross-sectional area by internal walls 118. However, it is within the scope of the present disclosure that the annular space may be divided into two, three, four, five, six, seven, eight, or more than eight secondary hydraulic pathways. It is also within the scope of the present disclosure that a portion of the plurality of secondary hydraulic pathways may include approximately the same cross-sectional shape and/or area. However, it is also within the scope of the present disclosure that a portion of the plurality of secondary hydraulic pathways may include a different cross-sectional shape and/or area than another portion of the plurality of secondary hydraulic pathways.

It is also within the scope of the present disclosure that casing conduit 50 may include a plurality of hydraulic pathways that may be defined by any suitable combination of the casing conduits of FIGS. 4-10. As an illustrative, non-exclusive example, the circumferentially distributed secondary hydraulic pathways of FIG. 6 may take the place of primary hydraulic pathway 100 of FIG. 4. As another illustrative, non-exclusive example, the concentric pipe structure of FIG. 9 may take the place of primary hydraulic pathway 100 of FIG. 10.

Figure 10:
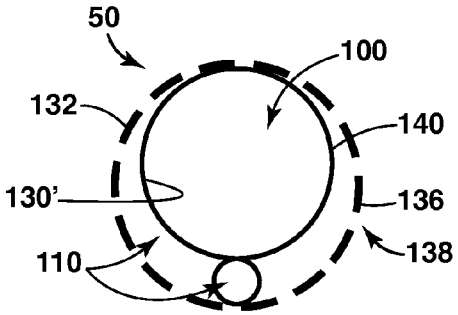
FIG. 10 is a schematic representation of a transverse cross-sectional view of an illustrative, non-exclusive example of a casing conduit according to the present disclosure, wherein the casing conduit is substantially similar to the casing conduit of FIG. 8 but further includes a permeable outer conduit.

It is also within the scope of the present disclosure that any suitable hydraulic pathway of the plurality of hydraulic pathways may include fluid-permeable casing conduit wall 136, as shown in FIG. 10. This may include any of the casing conduit walls of any of FIGS. 4-10 and/or any suitable portion of any of the casing conduit walls. As an illustrative, non-exclusive example, casing conduit walls may be fluid-permeable along their entire length. As another illustrative, non-exclusive example, casing conduit walls may be fluid-permeable over a portion of their length. This permeability may provide fluid communication between two or more of the plurality of hydraulic pathways and/or between one or more of the plurality of hydraulic pathways and an environment surrounding the casing conduit.

It is also within the scope of the present disclosure that casing conduit 50 may include any suitable cross-sectional shape, including a circular outer perimeter shape as shown in FIGS. 4-10. This cross-sectional shape may, but is not required to, be substantially constant along the length of the casing conduit. In addition, the cross-sectional dimensions may, but are not required to, be substantially constant along the length of the casing conduit. As an illustrative, non-exclusive example, when the casing conduit includes a circular cross-sectional shape, the cross-section may, but is not required to, include a substantially constant cross-sectional diameter.

It is also within the scope of the present disclosure that the casing conduit may have any suitable material properties and may include any suitable materials of construction. As an illustrative, non-exclusive example, the casing conduit may include a rigid (or at least substantially rigid) structure, such as may be obtained through the use of rigid materials during the manufacture of the casing conduit and/or through the use of a structural shape that imparts rigidity. As another illustrative, non-exclusive example, casing conduit 50 may include a metallic casing conduit, such as a steel and/or stainless steel casing conduit. As yet another illustrative, non-exclusive example, the casing conduit may be constructed of and/or coated with a material that is resistant to chemical degradation prior to and/or after being placed within well 10.

As discussed in more detail herein, well 10 according to the present disclosure includes at least a first casing conduit 50 that constitutes, forms, or otherwise includes a plurality of hydraulic pathways 60 and is contained within a wellbore 40. These hydraulic pathways may be in fluid communication with one or more production control assemblies 70. This may include one or more hydraulic pathways in fluid communication with a single production control assembly, as well as one or more production control assemblies in fluid communication with a single hydraulic pathway. These production control assemblies may be at any suitable location relative to wellbore, including locations that are proximal to or distal from the point where the casing conduit passes through mudline 156 or any other appropriate surface interface.

Figure 11:
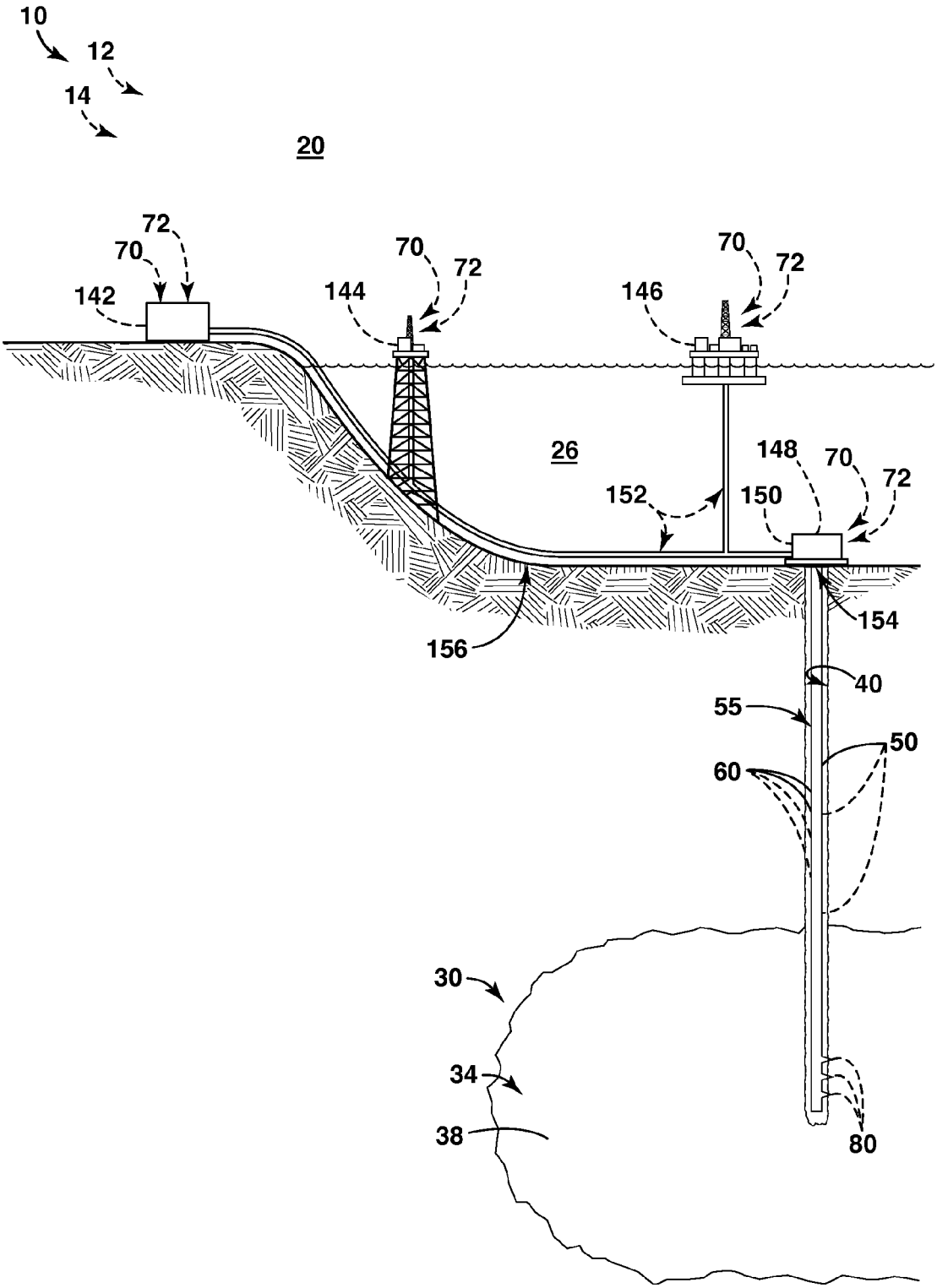
FIG. 11 is a schematic representation depicting illustrative, non-exclusive examples according to the present disclosure of the location of production control assemblies and/or of production control structures relative to an associated wellbore.

FIG. 11 provides illustrative, non-exclusive examples of the location of production control assemblies 70 with respect to casing conduit 50. In the illustrative example of FIG. 11, well 10 is a subsea well, though it is also within the scope of the present disclosure that well 10 may include a land-based well. The well of FIG. 11 includes a casing string 55, which includes a plurality of casing conduits 50 that define the plurality of hydraulic pathways 60. In the illustrative example of FIG. 11, well 10 provides fluid communication between subterranean formation 30 including reservoir 34 containing reservoir fluid 38 and subsea region 26. At least a portion of the plurality of hydraulic pathways is in fluid communication with one or more production control assemblies 70 and/or production control structures 72. This may include wellhead-based production control assembly 150, such as subsea-based production control assembly 148, floating platform-based production control assembly 146, fixed platform-based production control assembly 144, and/or land-based production control assembly 142. Connecting conduits 152 may provide fluid communication between wellhead 154 and production control assemblies that are located distal the wellhead. While FIG. 11 illustrates a plurality of production control assemblies 70 and/or production control structures 72 in a plurality of locations 142, 144, 146, 148, and 150, it is within the scope of the present disclosure that well 10 may include one or more production control assemblies 70 and/or production control structures 72 at any suitable location, including those illustrated in FIG. 11.

The presence of a plurality of hydraulic pathways 60 within casing string 55 may provide the ability to perform, such as via one or more production control assemblies and/or production control structures, multiple, simultaneous downhole operations within well 10. In addition, the presence of a plurality of production control assemblies, located both proximal to and distal from wellhead 154 may provide the ability to control these multiple, simultaneous downhole operations from a single location and/or from a plurality of locations. As an illustrative, non-exclusive example, well 10 may include a production well, and the production of reservoir fluids may be controlled by one or more of production control assemblies 70. As another illustrative, non-exclusive example, one of the plurality of production control assemblies may be utilized to provide a gas through one of the plurality of hydraulic pathways to the subterranean formation for a gas lift operation and another of the plurality of production control assemblies may be utilized to remove reservoir fluid from the well through another of the plurality of hydraulic pathways. Other illustrative, non-exclusive examples of performing multiple, simultaneous downhole operations and controlling these multiple, simultaneous downhole operations using production control assemblies that are located proximal to and/or distal from one another and/or the wellhead are within the scope of the present disclosure and are discussed in more detail herein.

Figure 12:
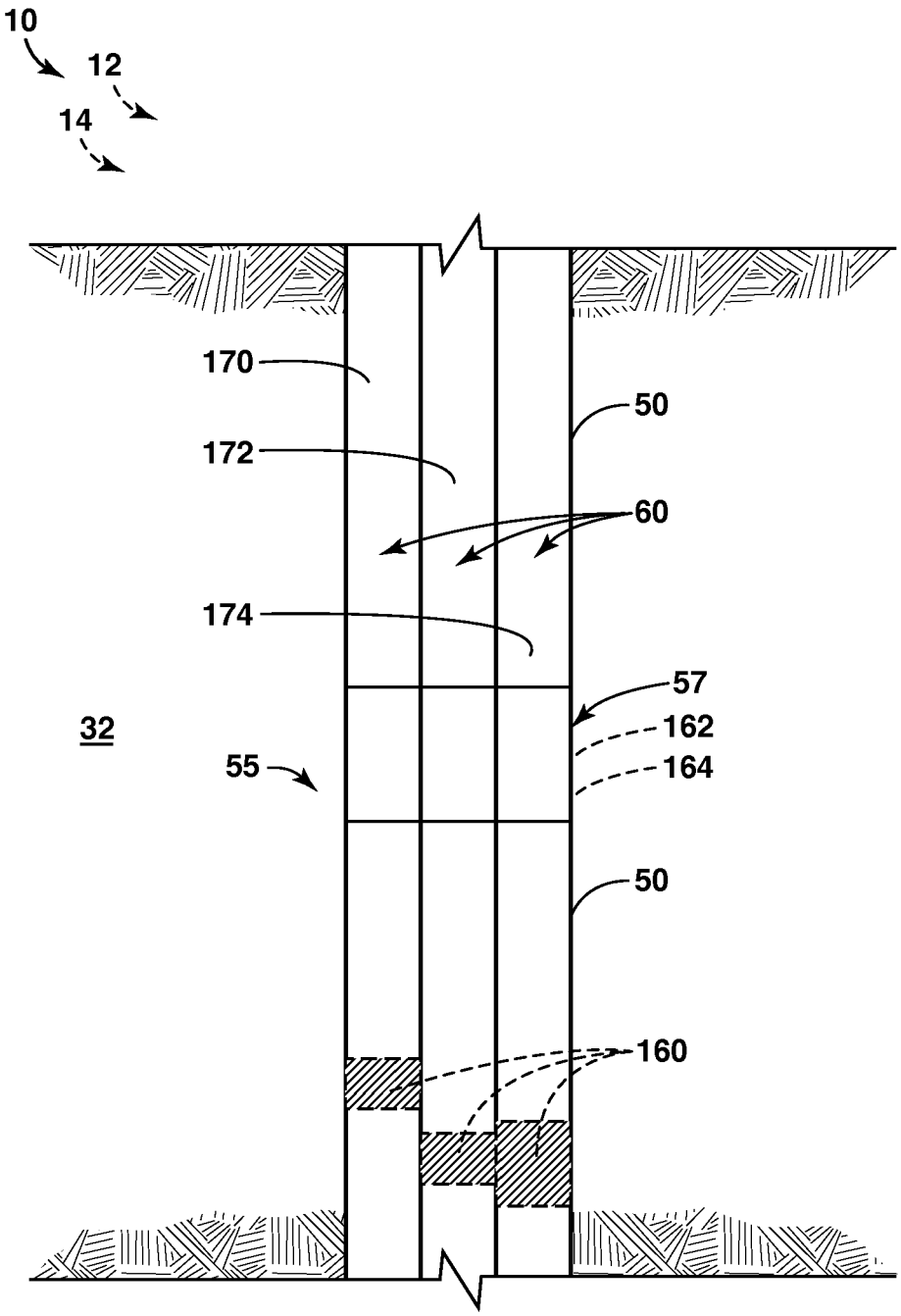
FIG. 12 is a fragmentary schematic representation of an illustrative, non-exclusive example of a casing string according to the present disclosure, wherein the casing string includes at least two casing conduits and a casing conduit junction, and further wherein the casing string includes three isolated hydraulic pathways and optionally includes one or more flow control devices.

As shown schematically in FIG. 12 and discussed in more detail herein, it is within the scope of the present disclosure that casing conduit 50 and/or casing string 55 may include a plurality of hydraulic pathways 60 that are isolated, or fluidly isolated, from each other. In FIG. 12, a portion of casing string 55 is shown and includes two casing conduits 50 and casing conduit junction 57. The casing string may include any suitable number of (isolated or other) hydraulic pathways 60. In the illustrative, non-exclusive example of FIG. 12, the casing string includes a first isolated hydraulic pathway 170, a second isolated hydraulic pathway 172, and a third isolated hydraulic pathway 174. Casing conduit junction 57 maintains isolated and continuous hydraulic pathways from one casing conduit to the next casing conduit. Thus, there is minimal or no fluid communication, either among the isolated hydraulic pathways or between the isolated hydraulic pathways and subsurface region 32 within the portion of casing conduit 55 shown in FIG. 12. Stated another way, the isolated hydraulic pathways of FIG. 12 are not configured, designed, or adapted to be in fluid communication either with one another or with the subsurface region; however, it is within the scope of the present disclosure that there may be a minimal amount of fluid communication due to imperfect seals, leakage, and the like.

In the illustrative example of isolated hydraulic pathways shown in FIG. 12, casing conduit junction 57 may include any suitable structure adapted to provide continuous and isolated flow for the isolated hydraulic pathways from one casing conduit to the next casing conduit. This may include the use of any suitable seal, thread, fitting, valve, manifold, or similar structures that may provide for a continuous hydraulic pathway from one casing conduit to the next. As an illustrative, non-exclusive example, casing conduit junction 57 may include a suitable manifold 162 configured or adapted to direct fluid flow from a hydraulic pathway of a first casing conduit to a corresponding hydraulic pathway of a second casing conduit. As another illustrative, non-exclusive example, casing conduit junction 57 may include a timed threaded connection 164 configured or adapted to provide rotational alignment of the plurality of hydraulic pathways as the casing conduits are threaded together and/or threaded into the casing conduit junction.

It is also within the scope of the present disclosure that one or more of the plurality of isolated hydraulic pathways may include a flow control device 160. Flow control device 160 may include any suitable structure that is configured to actively, passively, and/or selectively control the flow rate of fluid therethrough. This may include controlling the pressure of fluid on one side of the flow control device, controlling a pressure differential across the flow control device, controlling a direction of fluid flow through the flow control device, controlling a size of particulate matter that may pass through the flow control device, controlling a rate of fluid flow through the flow control device, and/or controlling the presence or absence of fluid flow within the flow control device, and may include both active and passive flow control devices.

As used herein, the term "passive flow control device" may refer to any flow control device that controls the flow of fluid therethrough based solely on the physical and/or mechanical properties of the flow control device and/or the fluid flowing therethrough. Illustrative, non-exclusive examples of passive flow control devices according to the present disclosure include a permeable membrane, a screen, a packed bed, a sintered plug, a check valve, an end cap, a mechanical flapper, a disappearing plug, a swellable packoff, a differential pressure regulator, a pressure regulator, an orifice, and/or a machined slot. As used herein, the term "active flow control device" may refer to any flow control device that actively controls the flow of fluid therethrough based on a system parameter that may or may not be directly related to either the flow control device or the fluid flowing therethrough. Illustrative, non-exclusive examples of active flow control devices according to the present disclosure include mass flow controllers, and/or solenoid valves.

Figure 13:
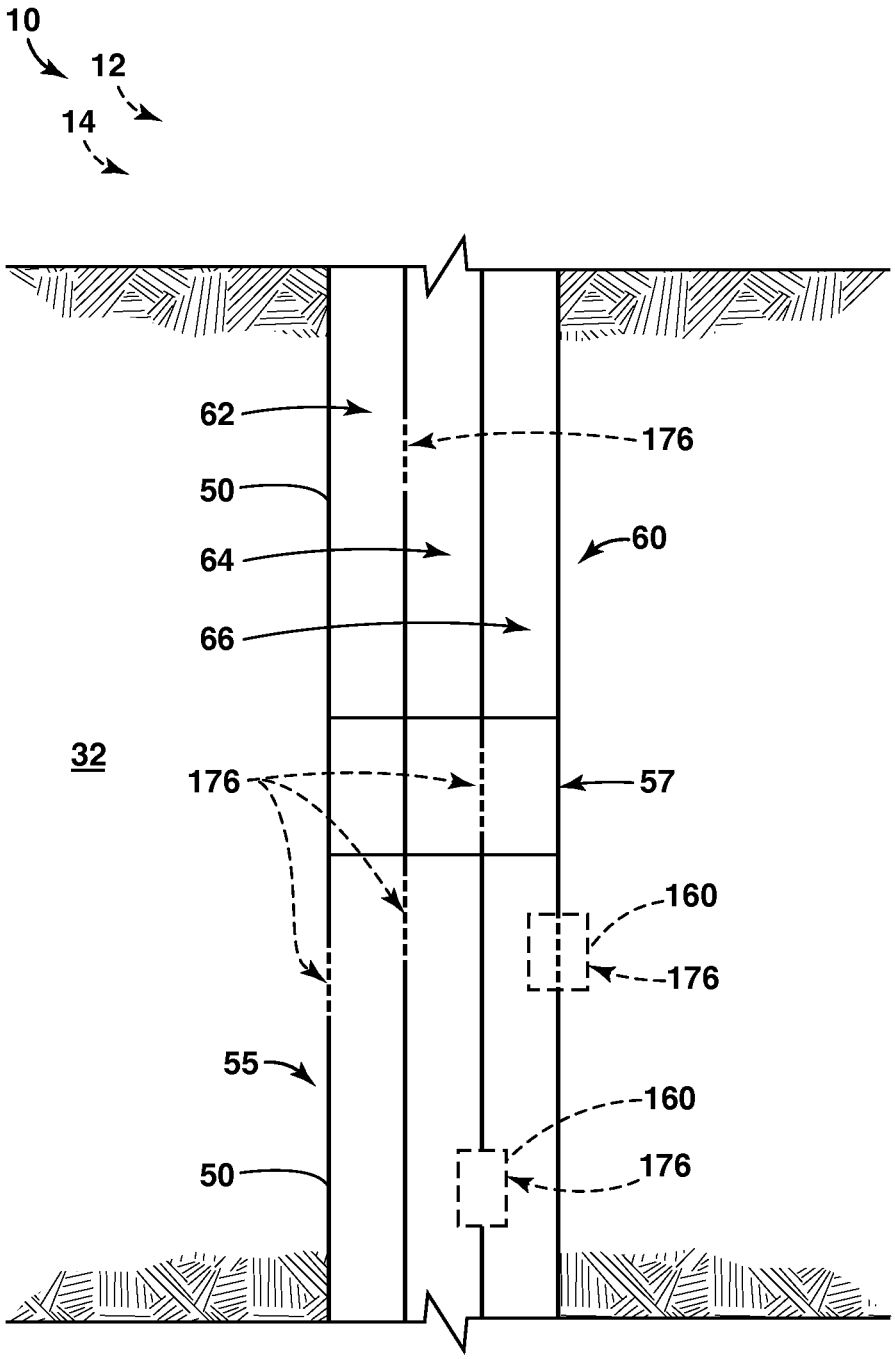
FIG. 13 is a fragmentary schematic representation of an illustrative, non-exclusive example of a casing string according to the present disclosure, wherein the casing string includes two casing conduits and a casing conduit junction, and further wherein the casing string includes three hydraulic pathways that may be in fluid communication with one another.

It is also within the scope of the present disclosure that casing conduit 50 and/or casing string 55 may include one or more hydraulic pathways 60 that include a fluid communication region 176, as shown in FIG. 13. In the illustrative, non-exclusive example of FIG. 13, a portion of casing string 55 including two casing conduits 50 and a casing conduit junction 57 is shown.

It is within the scope of the present disclosure that fluid communication regions 176 may provide fluid communication between and/or among a portion of the plurality of hydraulic pathways. As an illustrative, non-exclusive example, fluid communication regions 176 may provide fluid communication between first hydraulic pathway 62 and second hydraulic pathway 64, between first hydraulic pathway 62 and third hydraulic pathway 66, between second hydraulic pathway 64 and third hydraulic pathway 66, and/or between all of the interconnected hydraulic pathways, as opposed to just a subset thereof.

It is also within the scope of the present disclosure that the fluid communication regions may provide fluid communication between a portion of the plurality of hydraulic pathways and subsurface region 32. As an illustrative, non-exclusive example, fluid communication region 176 may provide fluid communication between third hydraulic pathway 66 and the subsurface region.

Fluid communication regions 176 may include any suitable structure. As an illustrative, non-exclusive example, fluid communication regions 176 may include any suitable type, shape, and/or number of opening(s), slot(s), or orifice(s). Additionally or alternatively, fluid communication regions 176 may include any suitable flow control device 160, including the illustrative, non-exclusive examples of flow control devices disclosed herein. The fluid communication regions may be located at any suitable location, illustrative, non-exclusive examples of which include fluid communication regions 176 that are located within casing conduit 50, as well as fluid communication regions 176 that are located within casing conduit junction 57. It is also within the scope of the present disclosure that the size, extent, length, width, and/or area of fluid communication regions 176 may vary. As an illustrative, non-exclusive example, the fluid communication regions may include a portion of a surface area of a given hydraulic pathway, including less than 1% of the surface area of the given hydraulic pathway, greater than 1% of the surface area of the given hydraulic pathway, greater than 5%, greater than 10%, greater than 25%, greater than 50%, greater than 75%, or greater than 95% of the surface area of the given hydraulic pathway.

Figure 14:
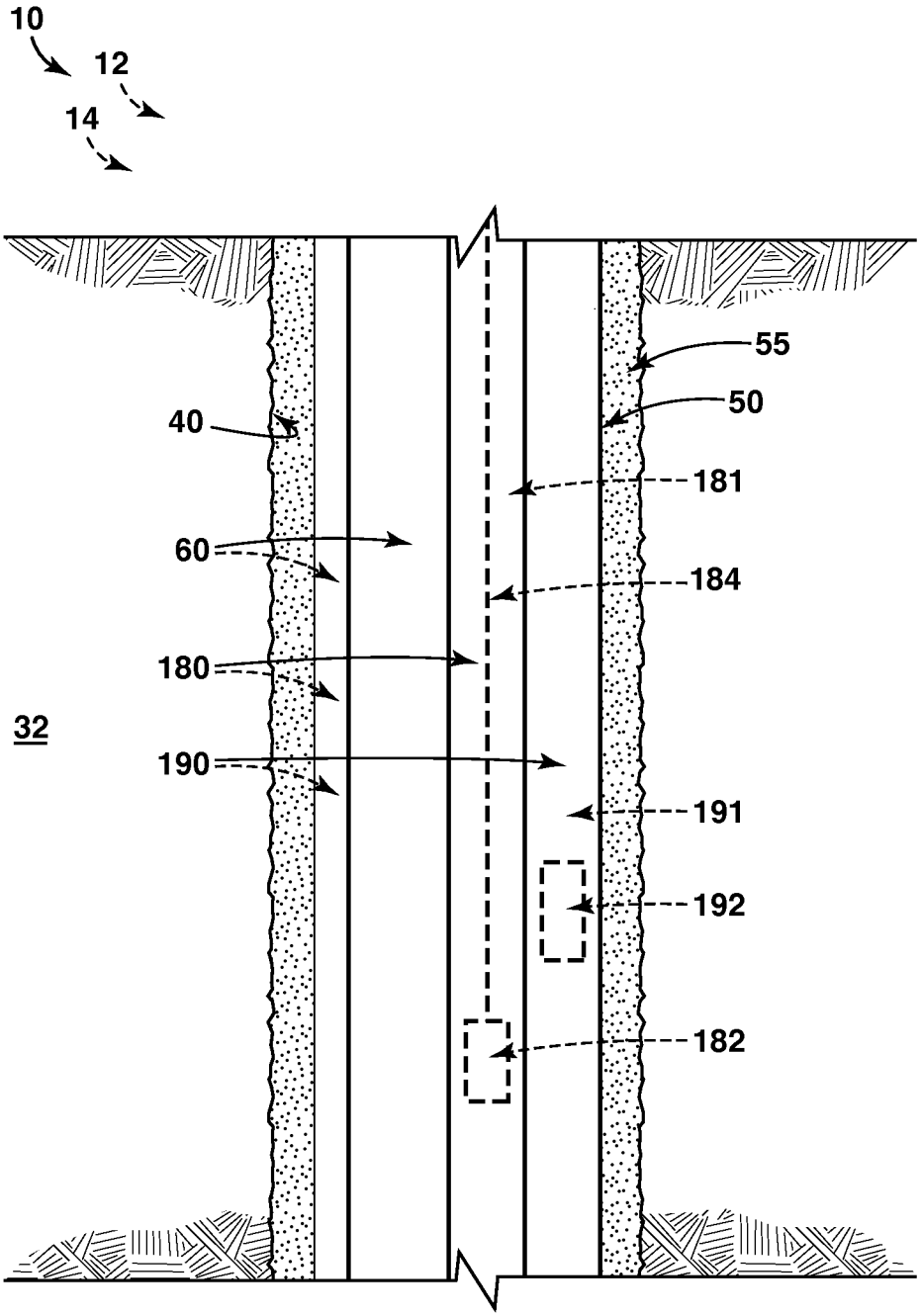
FIG. 14 is a fragmentary schematic representation of an illustrative, non-exclusive example of a casing string according to the present disclosure that may include a plurality of isolated and/or shared hydraulic, data, and/or mechanical conduits.

FIG. 14 provides an illustrative, non-exclusive example of additional access pathways that may be formed, constituted, and/or comprised by casing conduit 50. In addition to the plurality of hydraulic pathways 60 discussed herein, the casing conduit also may include one or more data access pathways 180 and/or one or more mechanical access pathways 190. It is within the scope of the present disclosure that at least one of the data access pathways and the mechanical access pathways may include dedicated data access pathways 181 and/or dedicated mechanical access pathways 191 that are not also utilized and/or are incapable of also providing a hydraulic pathway within the casing conduit. However, it is also within the scope of the present disclosure that at least one of the data access pathways and the mechanical access pathways may include data access pathways and/or mechanical access pathways that are shared between or among hydraulic, data, and mechanical access pathways.

Data access pathways 180, 181 may include any suitable structure adapted to provide and/or accommodate information transfer between at least a portion of subsurface region 32 and another portion of subsurface region 32 and/or surface region 20. As an illustrative, non-exclusive example, data access pathways 180, 181 may house, contain, and/or include a data collection assembly or transducer, such as sensor assembly 182, which may be configured to transmit information regarding the environment surrounding the data collection assembly to another location and/or device associated with well 10. This may be accomplished in any suitable manner, including through the use of sensor communication line 184 and/or via any suitable wireless data transmission protocol. Illustrative, non-exclusive examples of information that may be collected by the data collection assembly may include any suitable chemical, physical, and/or thermodynamic property of the casing conduit, the subsurface region, the fluid contained within the casing conduit, and/or the fluid contained within the subsurface region, including any suitable temperature, pressure, chemical composition, flow rate, acoustic property, electromagnetic property, stress, strain, nuclear property, and/or seismic characteristic.

It is within the scope of the present disclosure that any physical structures associated with data access pathways 180, 181 may be removable from the casing conduit and/or may be inserted into the casing conduit after the casing conduit has been placed within the wellbore. As an illustrative, non-exclusive example, sensor assembly 182 may be lowered into data access pathway 181 using sensor communication line 184 or any other suitable tether after casing conduit 50 has been installed within wellbore 40 and may be removable from data access pathway 181 as desired, such as to clean, repair, calibrate, and/or replace the sensor assembly. It is also within the scope of the present disclosure that any physical structures associated with data access pathways 180, 181 may be formed in, may form a part of, and/or may not be removable or separable from casing conduit 50. As an illustrative, non-exclusive example, sensor assembly 182 and/or sensor communication line 184 may be formed within casing conduit 50 when casing conduit 50 is manufactured and may not be designed to be removed and/or separated from the casing conduit.

Similarly, mechanical access pathways 190, 191 may include any suitable structure adapted to provide and/or accommodate mechanical access to at least a portion of subsurface region 32 from another portion of subsurface region 32 and/or surface region 20. As an illustrative, non-exclusive example, mechanical access pathways 190, 191 may house, contain, and/or include a mechanical device 192. Similar to sensor assembly 182 and/or sensor communication line 184, mechanical device 192 may be removable from casing conduit 50 or may be fixed within casing conduit 50 and may be inserted into casing conduit 50 after the casing conduit has been placed within wellbore 40 or may be inserted into casing conduit 50 as part of the process of manufacturing the casing conduit. Illustrative, non-exclusive examples of mechanical devices 192 that may be inserted into mechanical access pathways 190, 191 include wirelines, coiled tubing, jointed pipe, bits, mills, scrapers, logs, pigs, packers, plugs, tubulars, and/or hangars.

It is within the scope of the present disclosure that any casing string 55 that includes casing conduits 50 with mechanical and/or data access pathways may include casing conduit junctions that are configured, designed, or adapted to provide for continuity of the mechanical and/or data access pathway from one casing conduit to the next within the casing string. As an illustrative, non-exclusive example, when the mechanical and/or data access pathway includes an open conduit that is similar in structure to the plurality of hydraulic pathways, a manifold and/or timed connection similar to that discussed above with reference to FIGS. 12 and 14 may be utilized to provide the desired level of data and/or mechanical access pathway continuity from one casing conduit to the next casing conduit. As another illustrative, non-exclusive example, when the data access pathway includes sensor communication line 184 that is formed within and installed with the casing conduit, the casing conduit junction may include any suitable structure adapted to provide for continuity of the sensor communication line from one casing conduit to the next, such as any suitable electrical connection.

Figure 15:
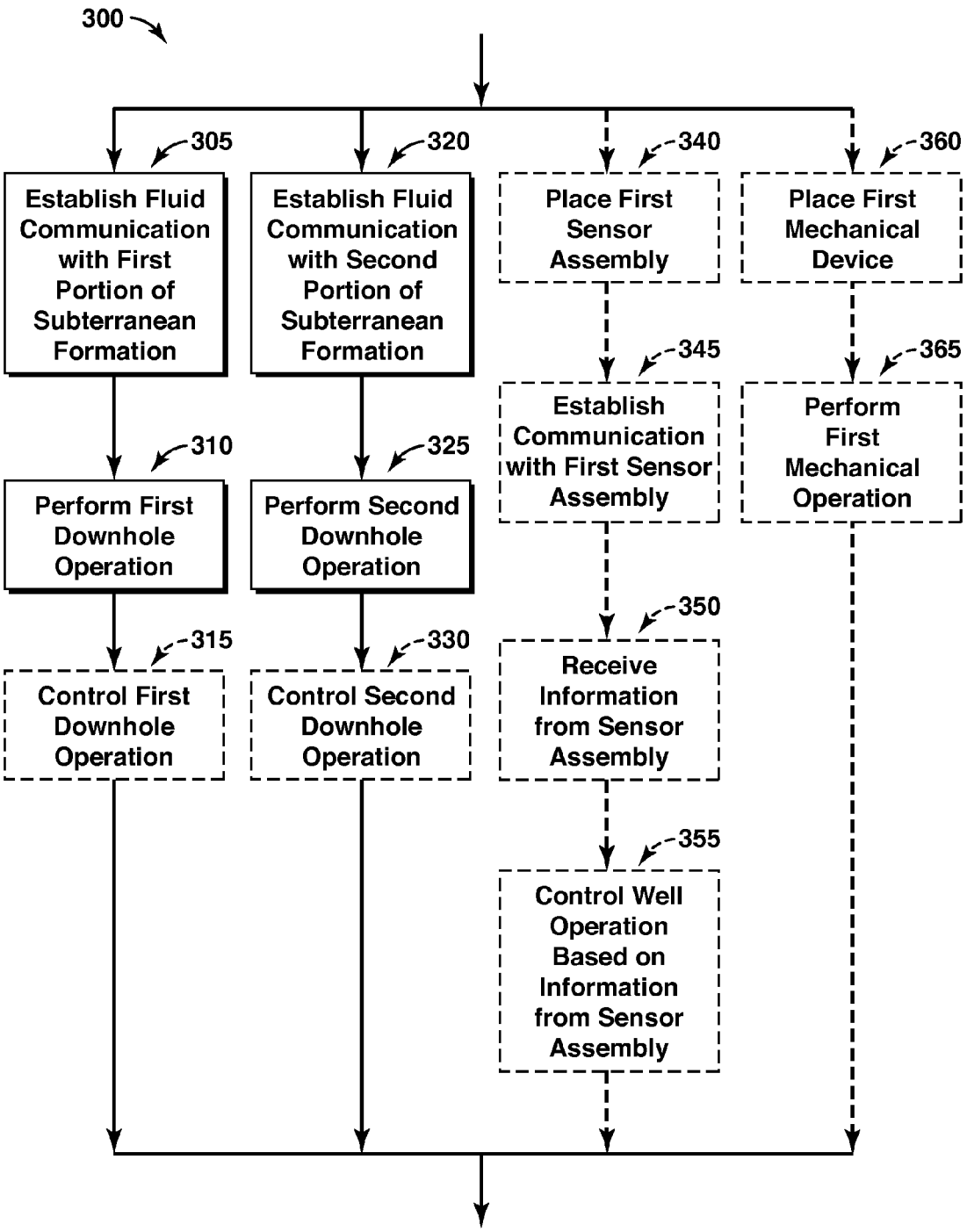
FIG. 15 is a flowchart providing illustrative, non-exclusive examples of methods of using a casing string including a plurality of hydraulic pathways according to the present disclosure.

FIG. 15 provides an illustrative, non-exclusive example of methods 300 of operating a well including a casing conduit 50 and/or casing string 55 that includes a plurality of hydraulic pathways 60. The methods of FIG. 15 include establishing fluid communication with a first portion of the subterranean formation at step 305, performing a first downhole operation associated with the first portion of the subterranean formation at step 310, and optionally controlling the first downhole operation at step 315.

Similarly, methods 300 include establishing fluid communication with a second portion of the subterranean formation at step 320, performing a second downhole operation associated with the second portion of the subterranean formation at step 325, and optionally controlling the second downhole operation at step 330. It is also within the scope of the present disclosure that method 300 may further include utilization of optional data access pathways 180, 181 to perform the optional steps of placing a first sensor assembly within at least a first data access pathway at step 340, establishing communication with the first sensor assembly at step 345, receiving information from the first sensor assembly at step 350, and/or controlling the operation of well 10 based at least in part on information from the first sensor assembly at step 355. Similarly, it is within the scope of the present disclosure that methods 300 may further include the utilization of optional mechanical access pathways 190, 191 to perform the optional steps of placing a first mechanical device in the mechanical access pathway at step 360 and/or performing a first mechanical operation within the well at step 365.

Controlling the first downhole operation at step 315 and/or controlling the second downhole operation at step 330 may include any suitable structure, method, and/or logic configured to control, regulate, and/or influence the downhole operation. As an illustrative, non-exclusive example, controlling the first downhole operation and/or controlling the second downhole operation may include controlling any suitable pressure, temperature, flow rate, production rate, and/or injection rate associated with the first portion of the subterranean formation and/or the second portion of the subterranean formation, respectively. As another illustrative, non-exclusive example, controlling the first downhole operation and/or controlling the second downhole operation may include utilizing a suitable production control assembly 70 and/or production control structure 72. As yet another illustrative, non-exclusive example, controlling the first downhole operation and/or controlling the second downhole operation may include controlling the downhole operation based at least in part on information received from sensor assembly 182, as described in step 355.

It is also within the scope of the present disclosure that information received from sensor assembly 182 may be utilized to control any other suitable well operation at step 355, including well operations that are not associated with the first downhole operation and/or the second downhole operations. As an illustrative, non-exclusive example, this may include controlling the first mechanical operation performed at step 365 based at least in part on information received from the sensor assembly at step 350.

As discussed in more detail herein, it is within the scope of the present disclosure that performing the first downhole operation at step 310 and performing the second downhole operation at step 325 may be performed in parallel and/or at least partially simultaneously therewith. In addition, it is also within the scope of the present disclosure that placing the first sensor assembly at step 340, establishing communication with the first sensor assembly at step 345, receiving information from the sensor assembly at step 350, controlling the operation of the well based at least in part on the information received from the sensor assembly at step 355, placing the first mechanical device at step 360, and/or performing the first mechanical operation at step 365 may be performed in parallel (and/or at least partially simultaneously) with the first downhole operation and/or the second downhole operation. Thus, casing conduits 50 and/or casing strings 55 according to the present disclosure that include a plurality of hydraulic pathways, data access pathways, and/or mechanical access pathways may permit, enable, allow, and/or provide for performing multiple, simultaneous hydraulic, data access, and/or mechanical operations simultaneously within well 10.

As used herein, performing an operation that is associated with a portion of the subterranean formation may include performing an operation that is in, within, near, in fluid communication with, and/or has an impact on the portion of the subterranean formation. As an illustrative, non-exclusive example, method 300 may include establishing fluid communication with a first portion of the subterranean formation and performing a first downhole operation within the first portion of the subterranean formation. As another illustrative, non-exclusive example, method 300 may include establishing fluid communication with a first portion of the subterranean formation and performing a first downhole operation that has an impact on any suitable property of the first portion of the subterranean formation, including the temperature, pressure, flow of fluid through, and/or chemical composition of fluid within the first portion of the subterranean formation.

Any of the illustrative steps of the methods of FIG. 15 may be repeated and/or moved without departing from the scope of the present disclosure. As an illustrative, non-exclusive example, methods 300 may further include establishing fluid communication with additional portion(s) of the subterranean formation, performing additional downhole operation (s) within the portion(s) of the subterranean formation, and/or controlling the additional downhole operation(s). As another illustrative, non-exclusive example, methods 300 may further include placing and/or establishing communication with a plurality of sensor assemblies, receiving information from at least a portion of the plurality of sensor assemblies, and/or controlling the operation of well 10 based at least in part on the information received from at least a portion of the plurality of sensor assemblies. As another illustrative, non-exclusive example, methods 300 may further include placing a plurality of mechanical devices and/or performing a plurality of mechanical operations within well 10.

The steps of methods 300 may be associated with any suitable activity that may take place within and/or be associated with well 10 and may vary with the particular activity. As an illustrative, non-exclusive example, well 10 may experience a plurality of operational (or operating) states over the course of its operational life. These may include a drilling state, a completing state, a stimulating state, a producing state, an abandoning state, and a killing state. Each of these operational states may include one or more distinct purposes and one or more distinct downhole operations may be associated with the operational states. The operational, or operating, states may additionally or alternatively be referred to as functional states, functional configurations, and/or operating configurations, and it is within the scope of the present disclosure that the systems and/or methods disclosed herein may be used in connection with other operational states of a well.

Although not required to all systems and/or methods according to the present disclosure, the presence of a plurality of hydraulic pathways and/or one or more data access pathways and/or mechanical access pathways within casing conduit 50 and/or casing string 55 may provide downhole operations that are accomplished in a simpler, faster, more efficient, and/or safer manner. As an illustrative, non-exclusive example, the systems and methods disclosed herein may ease seasonal operational constraints, facilitating Arctic drilling, completing, and/or production operations under ice. As another illustrative, non-exclusive example, the systems and methods disclosed herein may improve emergency deployment operations and/or decrease response times, such as facilitating a rapid response to a subsea blowout in deep water and/or in the Arctic. As another illustrative, non-exclusive example, the systems and methods disclosed herein may decrease the environmental impacts associated with well abandonment and/or killing operations, such as by facilitating fast, low-cost plugging and abandonment of subsea wells. As another illustrative, non-exclusive example, the systems and methods disclosed herein may facilitate advanced oil recovery techniques, such as deep lift operations in low-pressure or high water-cut wells. As yet another illustrative, non-exclusive example, the systems and methods disclosed herein may reduce the need for more invasive and/or frequent well drilling, completing, producing, and/or servicing activities, such as by facilitating equivalent circulating density reductions, rigless stimulations, deep cleanouts, and/or well cleanouts, as well as providing for more extensive data measurements within the well.

Figure 16:
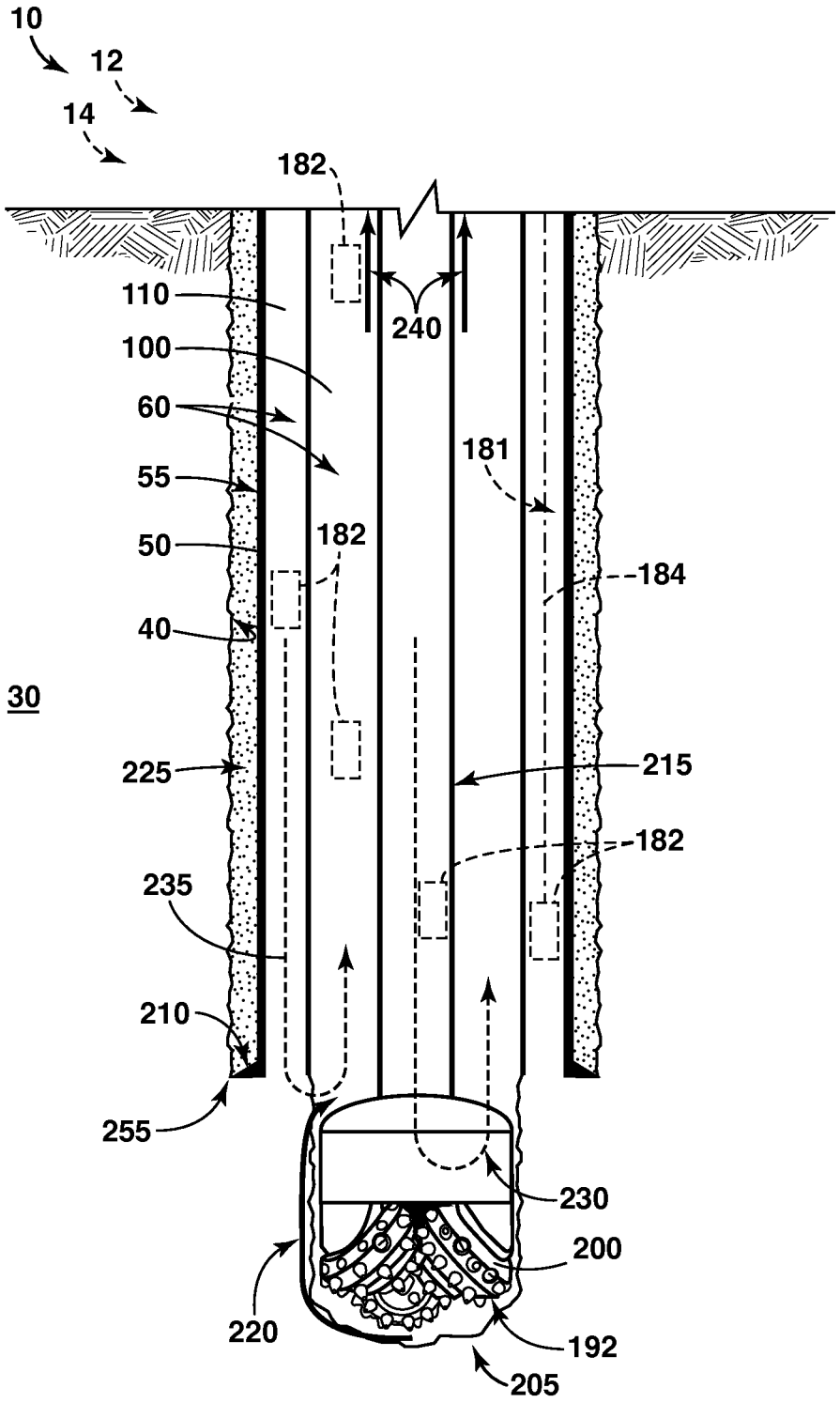
FIG. 16 is a fragmentary schematic representation of illustrative, non-exclusive examples of drilling operations utilizing a casing string according to the present disclosure.

As a more specific, but still illustrative, non-exclusive, example, FIG. 16 provides a schematic representation of hydraulic, data access, and/or mechanical access activities that may be performed as a part of the drilling state or drilling operation. In FIG. 16, a mechanical device 192, such as a drill bit 200, may be provided to a terminal depth 205 of the wellbore, such as to or even beyond terminal depth 255 of casing string 55, which may include an attached casing shoe 210. The drill bit may be attached to the end of a drill stem 215 and may be rotated within wellbore 40 to produce drilling spoils 220 and increase the depth of the wellbore. Casing string 55 may simply be placed within the wellbore or may be operatively attached to the wellbore using any suitable sealing material, such as cement 225. Casing string 55 may constitute a plurality of hydraulic pathways 60, including at least a primary hydraulic pathway 100 and a secondary hydraulic pathway 110. It is also within the scope of the present disclosure that well 10 may include one or more sensor assemblies 182 configured to measure one or more characteristics of the wellbore. During traditional drilling operations, primary drilling mud delivery stream 230 may be supplied through drill stem 215 to terminal depth 205 of the wellbore to facilitate the drilling operation.

With continued reference to FIG. 16 as well as to methods 300 of FIG. 15, it is within the scope of the present disclosure that performing the first downhole operation at step 310 may include supplying a secondary fluid stream 235, which may include drilling mud, to a terminal end 255 of casing string 55 through secondary hydraulic pathway 110; and performing the second downhole operation at step 325 may include removing at least a portion of the drilling mud supplied by primary drilling mud delivery stream 230, as well as the fluid supplied by secondary fluid stream 235 and drilling spoils 220 through primary hydraulic pathway 100 as discharge stream 240. In the illustrative, non-exclusive example of FIG.

16, primary hydraulic pathway 100 may be considered a shared hydraulic pathway that provides at least a hydraulic pathway and a mechanical access pathway within casing string 55. Thus, performing the first mechanical operation at step 365 of FIG. 15 may include performing the drilling operation using drill bit 200.

In addition, FIG. 16 also illustrates a plurality of optional sensor assemblies 182 that may be present at any suitable location within casing string 55. Thus, primary hydraulic pathway 100 and/or secondary hydraulic pathway 110 may include sensor assembly 182, making primary hydraulic pathway 100 and/or secondary hydraulic pathway 110 a shared hydraulic pathway and data access pathway. Additionally or alternatively, casing string 55 may further form or constitute isolated data access pathway 181 that may contain sensor assembly 182 and/or sensor communication line 184. As discussed in more detail herein, sensor assemblies 182 may detect information regarding the environment within well 10. This information may be utilized in any suitable matter during the operation of well 10.

As an illustrative, non-exclusive example, this information may be stored for later reference, use, and/or analysis. As another illustrative, non-exclusive example, this information may be utilized to control the drilling operation. This may include the use of any suitable mechanical, electronic, digital, analog, and/or manual control strategy. As an illustrative, non-exclusive example, sensor assembly 182 may be utilized to detect a pressure associated with well 10 and this pressure may be controlled to be substantially equal to a target pressure and/or within a suitable target pressure range. This may include increasing the flow rate of primary mud delivery stream 230 and/or secondary fluid stream 235 responsive to the detected pressure being lower than a desired or threshold value, decreasing the flow rate of discharge stream 240 responsive to the detected pressure being lower than a desired pressure or threshold value, decreasing the flow rate of primary mud delivery stream 230 and/or secondary fluid stream 235 responsive to the detected pressure being higher than a desired or threshold value, and/or increasing the flow rate of discharge stream 240 responsive to the detected pressure being higher than a desired pressure or threshold value.

As another illustrative, non-exclusive example, sensor assembly 182 may be utilized to detect an equivalent circulating density of a fluid contained within well 10 and this equivalent circulating density may be controlled to be equal to a target equivalent circulating density and/or within a desired equivalent circulating density range. In the illustrative example, secondary fluid stream 235 may include a lower-density fluid, such as a gas and/or CONGRAD beads, and controlling the equivalent circulating density may include controlling a ratio of the flow rate of secondary fluid stream 235 to the flow rate of primary mud delivery stream 230. This may include decreasing the ratio if the equivalent circulating density is lower than a desired or target value and/or increasing the ratio if the equivalent circulating density is greater than a desired or target value. The equivalent circulating density may be determined in any suitable manner, including measurement of the power supplied to pumps associated with the fluid streams, measurement of a pressure associated with the well, and/or a direct measurement of the equivalent circulating density. The pressure associated with the well may include any suitable pressure, including a pressure associated with a deepest portion of the casing string and/or a pressure at any other point within the well.

As discussed in more detail herein, it is within the scope of the present disclosure that at least a portion of the hydraulic, data access, and/or mechanical access operations described with reference to FIG. 16 may be performed simultaneously. As also discussed in more detail herein, FIG. 16 illustrates a configuration of casing conduit 50 and/or casing string 55 in which the conduit and/or casing string constitutes a plurality of hydraulic pathways including at least a first hydraulic pathway and a second hydraulic pathway and including one or more optional mechanical access pathways and/or data access pathways. FIG. 16 also illustrates that casing conduit 50 and/or casing string 55 according to the present disclosure may further include additional hydraulic pathways, mechanical access pathways, and/or data access pathways, such as drill stem 215, that are included within but not formed by the casing conduit and/or casing string.

Figure 17:
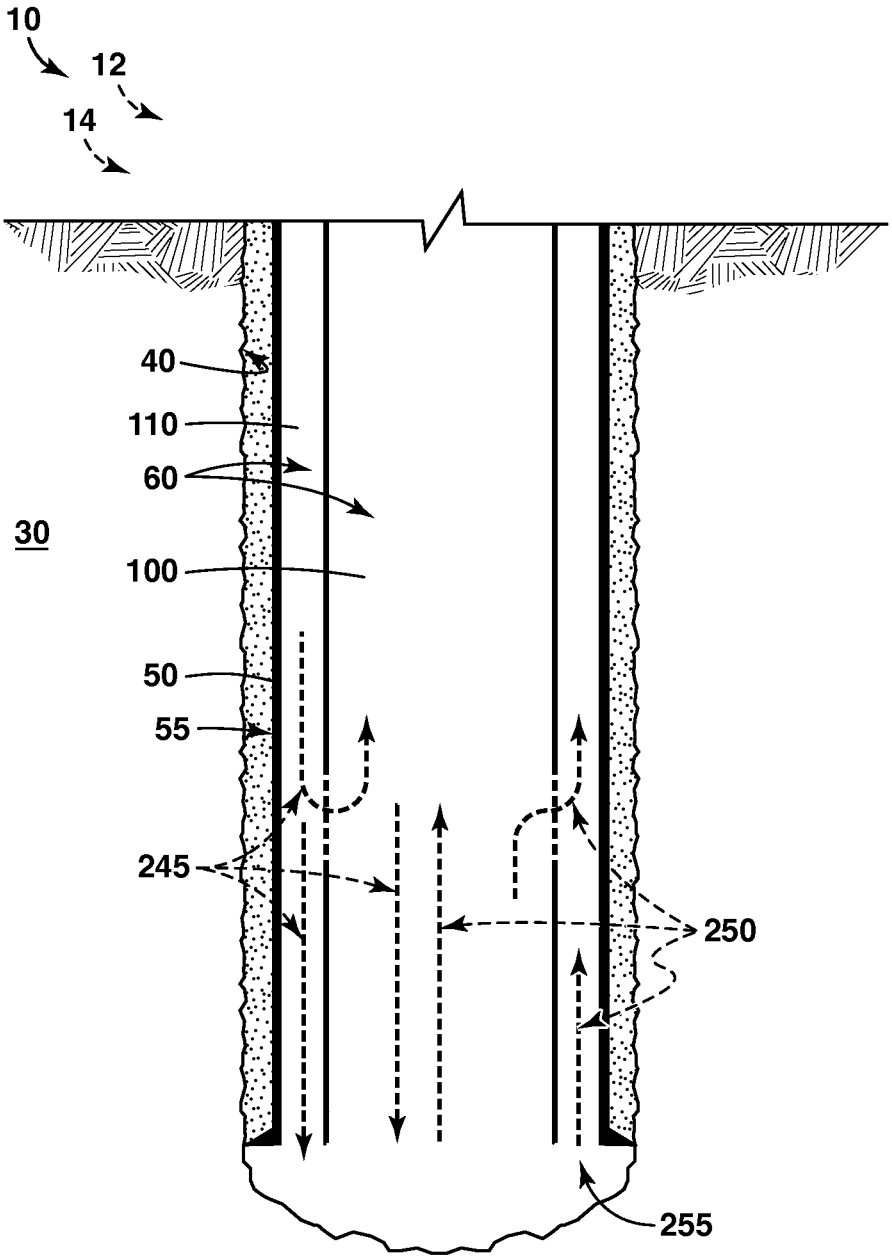
FIG. 17 is a fragmentary schematic representation of illustrative, non-exclusive examples of a completing, stimulating, abandoning, or killing operation utilizing a casing string according to the present disclosure.

FIG. 17 provides a schematic representation of an illustrative, non-exclusive example of a terminal end 255 of a casing string 55 according to the present disclosure that includes a plurality of casing conduits 50 and a plurality of hydraulic pathways 60 that include at least a primary hydraulic pathway 100 and a secondary hydraulic pathway 110. Each of the plurality of hydraulic pathways may be utilized to perform a separate downhole operation that may include the use of a fluid delivery stream 245 and/or a fluid removal stream 250. The casing string of FIG. 17 may be utilized to perform a plurality of downhole operations, including downhole operations associated with the completing state, the stimulating state, the producing state, the abandoning state, and/or the killing state. This may include delivering fluid(s) to and/or producing fluid(s) from any suitable portion(s) of subterranean formation 30, including terminal depth 205 of casing string 55. The use of casing string 55 that includes a plurality of hydraulic pathways 60, including at least primary hydraulic pathway 100 and at least one secondary hydraulic pathway 110, may provide for delivery to and/or production of fluids from the subterranean formation without the need to install, deploy, or otherwise utilize an additional and/or separate conduit or tubing string. This may improve the safety and/or efficiency of the downhole operation(s) and/or decrease the response time associated with performing the downhole operation(s).

As an illustrative, non-exclusive example, in the completing state, at least one of performing the first downhole operation and performing the second downhole operation may include at least one of supplying a sealing material to the wellbore, perforating the casing, unloading the well, cleaning the casing, installing production equipment into the wellbore, installing sand management equipment into the wellbore, installing water management equipment into the wellbore, and/or removing a fluid from the wellbore. As another illustrative, non-exclusive example, in the stimulating state, performing the first downhole operation may include supplying a stimulant fluid to the wellbore and performing the second downhole operation may include controlling a flow rate of at least one of the reservoir fluid and the stimulant fluid from the wellbore. Controlling the flow rate of at least one of the reservoir fluid and the stimulant fluid from the wellbore may include controlling a pressure associated with and/or within the wellbore and/or controlling the flow rate based at least in part on the pressure. As an illustrative, non-exclusive example, this may include controlling the pressure within the wellbore to be less than a fracture pressure of the subterranean formation. As another illustrative, non-exclusive example, this may include controlling the pressure within the wellbore to be greater than the fracture pressure of the subterranean formation. Illustrative, non-exclusive examples of stimulant fluids according to the present disclosure include any suitable pressurizing fluid adapted to pressurize at least a portion of the well, any suitable fracturing fluid adapted to fracture at least a portion of the subterranean formation, any suitable acidizing fluid adapted to chemically stimulate a portion of the subterranean formation, and/or any suitable cleaning fluid adapted to clean and/or remove undesirable material from a portion of the subterranean formation or the wellbore.

As another illustrative, non-exclusive example, in the producing state, at least one of performing the first downhole operation and performing the second downhole operation may include injecting a liquid into the wellbore, injecting a gas into the wellbore, injecting a pressurizing fluid into the wellbore, and/or producing a fluid from the subterranean formation. It is within the scope of the present disclosure that the produced fluid may include the reservoir fluid, the injected fluid(s), and/or a combination of the two. It is also within the scope of the present disclosure that the injecting may be performed at an injecting depth that is less than, equal to, or greater than a producing depth.

As another illustrative, non-exclusive example, in the abandoning state and/or the killing state, at least one of performing the first downhole operation and performing the second downhole operation may include providing a sealing material, such as cement, to the wellbore. This may include supplying the sealing material to the casing string, to a bottom portion, or terminal depth, of the casing string, and/or to a bottom portion, or terminal depth, of the wellbore.

In the above illustrative, non-exclusive examples, at least two of the downhole operations may be performed simultaneously and may include hydraulic access, data access, and/or mechanical access operations. As also discussed, the systems and methods may be utilized to provide at least two simultaneous and/or concurrent operations via the two or more hydraulic pathways constituted by the casing string, and these operations optionally may even deliver or receive fluids, solids, and/or data to the terminal depth of the casing string. In addition, the systems and methods disclosed herein have been described with reference to a well that provides a hydraulic connection between a surface region and a subterranean formation that includes a reservoir containing reservoir fluid. It is within the scope of the present disclosure that the reservoir may include and/or be a hydrocarbon reservoir, such as an oil reservoir, a crude oil reservoir, and/or a natural gas reservoir. It is also within the scope of the present disclosure that the reservoir fluid may include a hydrocarbon, such as oil or natural gas.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any of the references that are incorporated by reference herein define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A method of operating a well configured to provide a hydraulic connection between a surface region and a subterranean formation that includes a reservoir containing a reservoir fluid, the well including a casing string contained within a wellbore that extends between the surface region and the subterranean formation, wherein the casing string constitutes a plurality of hydraulic pathways between the surface region and the subterranean formation, the method comprising:

establishing a first fluid communication between the surface region and a first portion of the subterranean formation using a first hydraulic pathway of the casing string;

performing a first downhole operation in the first portion of the subterranean formation;

establishing a second fluid communication between the surface region and a second portion of the subterranean formation using a second hydraulic pathway of the casing string, wherein the second hydraulic pathway is different from the first hydraulic pathway; and performing a second downhole operation in the second portion of the subterranean formation.

A2. The method of paragraph A1, wherein the well is in fluid communication with a plurality of production control assemblies and the method further includes controlling the first downhole operation with a first production control assembly and controlling the second downhole operation with a second production control assembly, wherein the first production control assembly is different from the second production control assembly.

B1. A method of operating a well configured to provide a hydraulic connection between a surface region and a subterranean formation that includes a reservoir that contains a reservoir fluid, the well including a casing string contained within a wellbore that extends between the surface region and the subterranean formation, wherein the casing string constitutes a plurality of hydraulic pathways between the surface region and the subterranean formation, and further wherein the well is in fluid communication with a plurality of production control assemblies, the method comprising:

controlling a first downhole operation with a first production control assembly, wherein the first downhole operation is associated with a first hydraulic pathway of the casing string; and controlling a second downhole operation with a second production control assembly, wherein the second downhole operation is associated with a second hydraulic pathway of the casing string, and further wherein the second hydraulic pathway is different from the first hydraulic pathway, and still further wherein the first production control assembly is different from the second production control assembly.

B2. The method of paragraph B1, wherein the method includes establishing a first fluid communication between the surface region and a first portion of the subterranean formation using the first hydraulic pathway and establishing a second fluid communication between the surface region and a second portion of the subterranean formation using the second hydraulic pathway, wherein the method further includes performing the first downhole operation in the first portion of the subterranean formation, and performing the second downhole operation in the second portion of the subterranean formation.

C1. The method of any of paragraphs A1-B2, wherein the well includes a plurality of operational states, optionally including a drilling state, a completing state, a stimulating state, a producing state, an abandoning state, or a killing state.

C2. The method of paragraph C1, wherein, in the drilling state, performing the first downhole operation includes supplying a drilling mud to a terminal end of the wellbore and performing the second downhole operation includes removing the drilling mud from the wellbore.

C3. The method of paragraph C2, wherein performing the first downhole operation further includes providing a drill bit to the terminal end of the wellbore and producing drilling spoils at the terminal end of the wellbore, and optionally wherein performing the second downhole operation further includes removing the drilling spoils from the wellbore.

C4. The method of paragraph C2, wherein, in the drilling state, performing the first downhole operation includes supplying a drilling mud to the terminal end of the wellbore and performing the second downhole operation includes controlling an equivalent circulating density of the drilling mud, and optionally wherein performing the first downhole operation further includes providing a drill bit to a terminal end of the wellbore and producing drilling spoils at the terminal end of the wellbore.

C5. The method of paragraph C4, wherein controlling the equivalent circulating density of the drilling mud includes controlling the equivalent circulating density of the drilling mud based at least in part on a pressure associated with the well.

C6. The method of paragraph C5, wherein the pressure associated with the well includes the pressure associated with a deepest portion of the casing string.

C7. The method of any of paragraphs C4-C6, wherein controlling an equivalent circulating density of the drilling mud includes injecting a lower-density fluid into the wellbore, and optionally wherein the lower-density fluid includes at least one of a gas and CONGRAD beads.

C8. The method of paragraph C1, wherein, in the completing state, at least one of performing the first downhole operation and performing the second downhole operation includes at least one of supplying a sealing material to the wellbore, perforating the casing, unloading the well, cleaning the casing, installing production equipment into the wellbore, installing sand management equipment into the wellbore, installing water management equipment into the wellbore, and removing a fluid from the wellbore.

C9. The method of paragraph C1, wherein, in the stimulating state, performing the first downhole operation includes supplying a stimulant fluid to the wellbore and performing the second downhole operation includes controlling a flow rate of at least one of the reservoir fluid and the stimulant fluid from the wellbore.

C10. The method of paragraph C9, wherein controlling a flow rate of at least one of the reservoir fluid and the stimulant fluid from the wellbore further includes controlling a pressure within the wellbore, and optionally controlling a pressure of a fluid within the wellbore.

C11. The method of paragraph C10, wherein controlling a pressure within the wellbore includes controlling the pressure to be at least one of greater than a fracture pressure of the subterranean formation and less than a fracture pressure of the subterranean formation.

C12. The method of any of paragraphs C9-C11, wherein the stimulant fluid includes at least one of a pressurizing fluid, a fracturing fluid, an acidizing fluid, and a cleaning fluid.

C13. The method of paragraph C1, wherein, in the producing state, at least one of performing the first downhole operation and performing the second downhole operation includes at least one of injecting a liquid into the wellbore, injecting a gas into the wellbore, injecting a pressurizing fluid into the wellbore, and producing the reservoir fluid from the subterranean formation, and optionally wherein an injecting depth is at least one of greater than a producing depth and less than a producing depth.

C14. The method of paragraph C1, wherein, in at least one of the abandoning state and the killing state, at least one of performing the first downhole operation and performing the second downhole operation includes providing a sealing material to the wellbore.

C15. The method of paragraph C14, wherein providing the sealing material to the wellbore includes providing the sealing material to a bottom portion of the casing string, and optionally wherein providing the sealing material to the wellbore includes providing the sealing material to the bottom of the wellbore.

C16. The method of any of paragraphs C14-C15, wherein the sealing material includes cement.

C17. The method of any of paragraphs A1-C16, wherein the performing the first downhole operation and the performing the second downhole operation are simultaneous.

C18. The method of any of paragraphs A1-C17, wherein the casing string includes an outer casing string surface and a plurality of inner casing string surfaces, and further wherein the casing string constituting the plurality of hydraulic pathways includes the plurality of inner casing string surfaces defining at least a portion of the plurality of hydraulic pathways.

C19. The method of paragraph C18, wherein each of the plurality of inner casing string surfaces is contained within the outer casing string surface.

C20. The method of any of paragraphs C18-C19, wherein the plurality of inner casing string surfaces are separated from at least a portion of the outer casing string surface by a casing string wall.

C21. The method of any of paragraphs C18-C20, wherein the plurality of inner casing string surfaces defining at least a portion of the hydraulic pathways includes the plurality of inner casing string surface defining at least a portion of the first hydraulic pathway and the plurality of inner casing string surfaces defining at least a portion of the second hydraulic pathway.

C22. The method of any of paragraphs A1-C21, wherein the casing string includes a plurality of casing conduits that each includes a longitudinal axis, and further wherein the casing conduits are operatively attached along their respective longitudinal axes to form the casing string.

C23. The method of paragraph C22, wherein at least a portion of the plurality of casing conduits include a monolithic structure that forms at least a portion of the plurality of hydraulic pathways.

C24. The method of any of paragraphs C22-C23, wherein at least a portion of the plurality of casing conduits include a composite structure that includes at least two components that are operatively attached to one another to form at least a portion of the plurality of hydraulic pathways.

C25. The method of paragraph C24, wherein the at least two components of the casing conduits are operatively attached by at least one of an adhesive, an epoxy, a weld, a fixture, a fastener, a thread, and a clasp.

C26. The method of any of paragraphs A1-C25, wherein at least one of the plurality of hydraulic pathways further includes a flow control device, and optionally wherein the method further includes controlling the flow of fluid through the hydraulic pathway with the flow control device.

C27. The method of paragraph C26, wherein the flow control device includes at least one of a permeable membrane, a check valve, an end cap, a mechanical flapper, a disappearing plug, a swellable packoff, and a machined slot.

C28. The method of any of paragraphs A1-C27, wherein the casing string further forms at least a first data pathway, and further wherein the method further includes monitoring a variable associated with the well using the first data pathway.

C29. The method of paragraph C28, wherein the first data pathway is distinct from at least a portion of the plurality of hydraulic pathways.

C30. The method of any of paragraphs A1-C29, wherein the casing string further forms at least a first mechanical access pathway, and further wherein the method further includes inserting a mechanical device into the wellbore using the first mechanical access pathway.

C31. The method of paragraph C30, wherein at least a portion of the first mechanical access pathway is distinct from at least a portion of the plurality of hydraulic pathways.

C32. The method of any of paragraphs A1-C31, wherein at least a first portion of the plurality of hydraulic pathways is hydraulically isolated from at least a second portion of the plurality of hydraulic pathways.

C33. The method of any of paragraphs A1-C32, wherein at least a first portion of the plurality of hydraulic pathways is in fluid communication with at least a second portion of the plurality of hydraulic pathways.

C34. The method of any of paragraphs C22-C33, wherein at least a first casing conduit is operatively attached to at least a second casing conduit at a casing conduit junction.

C35. The method of paragraph C34, wherein the casing conduit junction includes a manifold, and optionally wherein the manifold provides independent flow paths for at least a portion of the plurality of hydraulic pathways.

C36. The method of any of paragraphs C34-C35, wherein the casing conduit junction includes a timed connection, and optionally wherein the timed connection provides independent flow paths for at least a portion of the plurality of hydraulic pathways.

C37. The method of any of paragraphs A1-C36, wherein the plurality of hydraulic pathways includes at least a primary hydraulic pathway and at least a first secondary hydraulic pathway including a secondary hydraulic pathway conduit, and further wherein the casing string includes an inner basal conduit surface defining at least a portion of the primary hydraulic pathway, an outer basal conduit surface, and a basal conduit wall between the inner surface and the outer surface.

C38. The method of paragraph C37, wherein the at least a first secondary hydraulic pathway conduit is operatively attached to the inner basal conduit surface.

C39. The method of any of paragraphs C37-C38, wherein the at least a first secondary hydraulic pathway conduit forms a portion of the inner basal conduit surface.

C40. The method of any of paragraphs C37-C39, wherein the at least a first secondary hydraulic pathway conduit is operatively attached to the outer basal conduit surface.

C41. The method of any of paragraphs C37-C40, wherein the at least a first secondary hydraulic pathway conduit forms a portion of the outer basal conduit surface.

C42. The method of any of paragraphs C37-C41, wherein the at least a first secondary hydraulic pathway conduit is contained within the basal conduit wall.

C43. The method of any of paragraphs C37-C42, wherein the at least a first secondary hydraulic pathway conduit forms a portion of the basal conduit wall.

C44. The method of any of paragraphs A1-C43, wherein the casing string has a substantially uniform transverse cross-sectional shape along its length.

C45. The method of paragraph C44, wherein the casing string has a substantially circular transverse cross-sectional shape, and optionally wherein a transverse cross-section of the casing string has a substantially constant diameter.

C46. The method of any of paragraphs A1-C45, wherein the casing string includes a rigid casing string, and optionally wherein the casing string includes a metallic casing string, and further optionally wherein the casing string includes steel.

C47. The method of any of paragraphs A1-C46, wherein the first portion of the subterranean formation has a first depth, the second portion of the subterranean formation has a second depth, and optionally wherein the first depth is at least one of the same as the second depth and different from the second depth.

C48. The method of any of paragraphs A1-C47, wherein the subterranean formation includes a plurality of subterranean formations that include at least a first formation and a second formation, and further wherein establishing a first fluid communication between the surface region and the first portion of the subterranean formation includes establishing a first fluid communication between the surface region and the first formation, and still further wherein establishing a second fluid communication between the surface region and the second portion of the subterranean formation includes establishing a second fluid communication between the surface region and the second formation.

C49. The method of paragraph C48, wherein the first formation has a first formation depth and the second formation has a second formation depth, and further wherein the first formation depth is at least one of greater than the second formation depth and less than the second formation depth.

C50. The method of any of paragraphs A1-C49, wherein at least one of establishing a first fluid communication between the surface region and the first portion of the subterranean formation and establishing a second fluid communication between the surface region and the second portion of the subterranean formation includes communicating with a plurality of depths within the subterranean formation.

C51. The method of paragraph C50, wherein the plurality of depths includes at least a first depth and at least a second depth, and further wherein the at least a first depth is different from the at least a second depth, and optionally wherein the at least a first depth is at least 1 meter, optionally including at least 5 meters, at least 10 meters, at least 25 meters, at least 50 meters, at least 100 meters, or at least 500 meters different from the at least a second depth.

C52. The method of any of paragraphs A1-C51, wherein the casing string includes a terminal depth, and further wherein at least one of establishing a first fluid communication between the surface region and the first portion of the subterranean formation and establishing a second fluid communication between the surface region and the second portion of the subterranean formation includes establishing fluid communication with the terminal depth of the casing string.

C53. The method of any of paragraphs A1-C52, wherein at least two of the plurality of production control assemblies are integrated into a single production control structure.

C54. The method of any of paragraphs A1-C53, wherein at least two of the plurality of production control assemblies are spaced-apart production control assemblies.

C55. The method of paragraph C54, wherein the spaced-apart production control assemblies are separated by a distance of at least 1 meter, optionally including separation distances of at least 10 meters, 25 meters, 50 meters, 100 meters, 500 meters, 1 kilometer, 5 kilometers, 10 kilometers, 15 kilometers, 20 kilometers, 25 kilometers, or separation distances of at least 30 kilometers.

C56. The method of any of paragraphs C54-C55, wherein at least one of the spaced-apart production control assemblies is located on the sea floor.

C57. The method of any of paragraphs C54-C56, wherein at least one of the spaced-apart production control assemblies is located on land.

C58. The method of any of paragraphs C54-C57, wherein at least one of the spaced-apart production control assemblies is located on a floating platform.

C59. The method of any of paragraphs C54-C58, wherein at least one of the spaced-apart production control assemblies is located on a fixed platform.

C60. The method of any of paragraphs A1-C59, wherein the plurality of hydraulic pathways includes greater than 2 hydraulic pathways, optionally including greater than 3, greater than 5, greater than 10, greater than 15, or greater than 20 hydraulic pathways, and further optionally wherein the method includes carrying out a plurality of downhole operations using at least a portion of the plurality of hydraulic pathways, and still further optionally wherein at least a portion of the downhole operations are carried out simultaneously.

C61. The method of any of paragraphs A1-C60, wherein the reservoir includes a hydrocarbon reservoir and the reservoir fluid includes a hydrocarbon.

C62. The method of paragraph C61, wherein the hydrocarbon includes oil, and the well is an oil well.

C63. The method of paragraph C61, wherein the hydrocarbon includes natural gas, and the well is a natural gas well.

D1. A casing conduit, comprising:

a basal conduit; and a plurality of hydraulic pathways that include at least a first hydraulic pathway and at least a second hydraulic pathway, wherein at least the first hydraulic pathway and the second hydraulic pathway are adapted to provide hydraulic communication between a first end of the casing conduit and a second end of the casing conduit.

D2. The casing conduit of paragraph D1, wherein the casing conduit includes an outer casing conduit surface and a plurality of inner casing conduit surfaces, and further wherein the casing conduit constitutes a plurality of hydraulic pathways and the plurality of inner casing conduit surfaces define at least a portion of the plurality of hydraulic pathways.

D3. The casing conduit of paragraph D2, wherein each of the plurality of inner casing conduit surfaces is contained within the outer casing conduit surface.

D4. The casing conduit of any of paragraphs D2-D3, wherein the plurality of inner casing conduit surfaces are separated from at least a portion of the outer casing conduit surface by a casing conduit wall.

D5. The casing conduit of any of paragraphs D2-D4, wherein the plurality of inner casing conduit surfaces defining at least a portion of the hydraulic pathways includes the plurality of inner casing conduit surfaces defining at least a portion of a first hydraulic pathway and the plurality of inner casing conduit surfaces defining at least a portion of a second hydraulic pathway.

D6. The casing conduit of any of paragraphs D1-D5, wherein the casing conduit has a substantially uniform transverse cross-sectional shape along its length.

D7. The casing conduit of paragraph D6, wherein the casing conduit has a substantially circular transverse cross-sectional shape, and optionally wherein a transverse cross-section of the casing conduit has a substantially constant diameter.

D8. The casing conduit of any of paragraphs D1-D7, wherein the casing conduit includes a rigid casing conduit, and optionally wherein the casing conduit includes a metallic casing conduit, and further optionally wherein the casing conduit includes steel.

D9. The casing conduit of any of paragraphs D1-D8, wherein the plurality of hydraulic pathways includes greater than 2 hydraulic pathways, optionally including greater than 3 hydraulic pathways, greater than 5 hydraulic pathways, greater than 10 hydraulic pathways, greater than 15 hydraulic pathways, or greater than 20 hydraulic pathways.

D10. The casing conduit of any of paragraphs D1-D9, wherein at least a first portion of the plurality of hydraulic pathways is hydraulically isolated from at least a second portion of the plurality of hydraulic pathways.

D11. The casing conduit of any of paragraphs D1-D10, wherein at least a first portion of the plurality of hydraulic pathways is in fluid communication with at least a second portion of the plurality of hydraulic pathways.

D12. The casing conduit of any of paragraphs D1-D11, wherein the plurality of hydraulic pathways includes at least a primary hydraulic pathway and at least a first secondary hydraulic pathway including a secondary hydraulic pathway conduit, and further wherein the casing conduit includes an inner basal conduit surface defining at least a portion of the primary hydraulic pathway, an outer basal conduit surface, and a basal conduit wall between the inner basal conduit surface and the outer basal conduit surface.

D13. The casing conduit of paragraph D12, wherein the at least a first secondary hydraulic pathway conduit is operatively attached to the inner basal conduit surface.

D14. The casing conduit of any of paragraphs D12-D13, wherein the at least a first secondary hydraulic pathway conduit forms a portion of the inner basal conduit surface.

D15. The casing conduit of any of paragraphs D12-D14, wherein the at least a first secondary hydraulic pathway conduit is operatively attached to the outer basal conduit surface.

D16. The casing conduit of any of paragraphs D12-D15, wherein the at least a first secondary hydraulic pathway conduit forms a portion of the outer basal conduit surface.

D17. The casing conduit of any of paragraphs D12-D16, wherein the at least a first secondary hydraulic pathway conduit is contained within the basal conduit wall.

D18. The casing conduit of any of paragraphs D12-D17, wherein the at least a first secondary hydraulic pathway conduit forms a portion of the basal conduit wall.

D19. The casing conduit of any of paragraphs D1-D18, wherein at least one of the plurality of hydraulic pathways further includes a flow control device.

D20. The casing conduit of paragraph D19, wherein the flow control device includes at least one of a permeable membrane, a check valve, an end cap, a mechanical flapper, a disappearing plug, a swellable packoff, and a machined slot.

D21. The casing conduit of any of paragraphs D1-D20, wherein the casing conduit includes a monolithic structure that forms at least a portion of the plurality of hydraulic pathways, and optionally wherein the portion of the plurality of hydraulic pathways includes at least two hydraulic pathways, further optionally including at least three hydraulic pathways, at least four hydraulic pathways, at least five hydraulic pathways, or more than five hydraulic pathways.

D22. The casing conduit of any of paragraphs D1-D21, wherein the casing conduit includes a composite structure including at least two components that are operatively attached to one another to form at least a portion of the plurality of hydraulic pathways.

D23. The casing conduit of paragraph D22, wherein the at least two components of the casing conduit are operatively attached by at least one of an adhesive, an epoxy, a weld, a fixture, a fastener, a thread, and a clasp.

E1. A casing string including a plurality of casing conduits as described in any of paragraphs D1-D23.

E2. The casing string of paragraph E1, wherein each of the plurality of casing conduits includes a longitudinal axis, and further wherein the casing conduits are operatively attached along their respective longitudinal axes to form the casing string.

E3. The casing string of any of paragraphs E1-E2, wherein the plurality of casing conduits includes at least a first casing conduit and at least a second casing conduit, and further wherein the at least a first casing conduit is operatively attached to the at least a second casing conduit at a casing conduit junction.

E4. The casing string of paragraph E3, wherein the casing conduit junction includes a manifold, and optionally wherein the manifold provides independent flow paths for at least a portion of the plurality of hydraulic pathways.

E5. The casing string of any of paragraphs E3-E4, wherein the casing conduit junction includes a timed connection, and optionally wherein the timed connection provides independent flow paths for at least a portion of the plurality of hydraulic pathways.

F1. An oil well including at least a first casing conduit as described in any of paragraphs D1-D23 and configured to provide a hydraulic connection between a surface region and a subterranean formation that includes a reservoir, the well being adapted to produce a reservoir fluid from the reservoir and having the casing conduit contained within a wellbore that extends between the surface region and the subterranean formation.

F2. The oil well of paragraph F1, wherein the at least a first casing conduit forms a portion of a casing string that is contained within the wellbore and extends between the surface region and the subterranean formation.

G1. An oil well including at least a first casing string as described in any of paragraphs E1-E5 and configured to provide a hydraulic connection between a surface region and a subterranean formation that includes a reservoir, the oil well being adapted to produce a reservoir fluid from the reservoir and having the casing string contained within a wellbore that extends between the surface region and the subterranean formation.

H1. The oil well of any of paragraphs F2-G1, wherein the oil well further includes at least a first data pathway formed by the casing string and adapted to provide a data connection between the surface region and a portion of the subterranean formation.

H2. The oil well of paragraph H1, wherein the at least a first data pathway is distinct from the plurality of hydraulic pathways.

H3. The oil well of any of paragraphs F2-H2, wherein the oil well further includes at least a first mechanical access pathway formed by the casing string and adapted to provide access to the subterranean formation for a mechanical device.

H4. The oil well of paragraph H3, wherein the at least a first mechanical access pathway is distinct from the plurality of hydraulic pathways.

H5. The oil well of any of paragraphs F1-H4, wherein the oil well further includes a plurality of production control assemblies that includes at least a first production control assembly in fluid communication with at least a first hydraulic pathway and at least a second production control assembly in fluid communication with at least a second hydraulic pathway, wherein the first production control assembly is different from the second production control assembly and the first hydraulic pathway is different from the second hydraulic pathway.

H6. The oil well of paragraph H5, wherein at least two of the plurality of production control assemblies are integrated into a single production control structure.

H7. The oil well of any of paragraphs H5-H6, wherein at least two of the plurality of production control assemblies are spaced-apart production control assemblies.

H8. The oil well of paragraph H7, wherein the spaced-apart production control assemblies are separated by a distance of at least 1 meter, optionally including separation distances of at least 10 meters, 25 meters, 50 meters, 100 meters, 500 meters, 1 kilometer, 5 kilometers, 10 kilometers, 15 kilometers, 20 kilometers, 25 kilometers, or separation distances of at least 30 kilometers.

H9. The oil well of any of paragraphs H7-H8, wherein at least one of the spaced-apart production control assemblies is located on the sea floor.

H10. The oil well of any of paragraphs H7-H9, wherein at least one of the spaced-apart production control assemblies is located on land.

H11. The oil well of any of paragraphs H7-H10, wherein at least one of the spaced-apart production control assemblies is located on a floating platform.

H12. The oil well of any of paragraphs H7-H11, wherein at least one of the spaced-apart production control assemblies is located on a fixed platform.

J1. The use of any of the methods of any of paragraphs A1-C61 with any of the systems of paragraphs D1-H12.

J2. The use of any of the systems of paragraphs D1-H12 with any of the methods of any of paragraphs A1-C61.

J3. The use of any of the systems of paragraphs D1-H12 to produce oil.

J4. The use of any of the methods of paragraphs A1-C61 to produce oil.

Still further illustrative, non-exclusive examples of systems and methods according to the present disclosure include:

K1. A method of operating a well configured to provide a hydraulic connection between a surface region and a subterranean formation that includes a reservoir containing a reservoir fluid, the well including a casing string contained within a wellbore that extends between the surface region and the subterranean formation, wherein the casing string constitutes a plurality of hydraulic pathways between the surface region and the subterranean formation, the method comprising:

establishing a first fluid communication between the surface region and a first portion of the subterranean formation using a first hydraulic pathway of the casing string;

performing a first downhole operation in the first portion of the subterranean formation;

establishing a second fluid communication between the surface region and a second portion of the subterranean formation using a second hydraulic pathway of the casing string, wherein the second hydraulic pathway is different from the first hydraulic pathway; and performing a second downhole operation in the second portion of the subterranean formation.

K2. The method of paragraph K1, wherein the well is in fluid communication with a plurality of production control assemblies and the method further includes controlling the first downhole operation with a first production control assembly and controlling the second downhole operation with a second production control assembly, wherein the first production control assembly is different from the second production control assembly.

K3. The method of any of paragraphs K1-K2, wherein the well includes a plurality of operational states, including at least a drilling state, and further wherein, in the drilling state, performing the first downhole operation includes supplying a drilling mud to a terminal end of the wellbore and performing the second downhole operation includes removing the drilling mud from the wellbore.

K4. The method of paragraph K3, wherein performing the first downhole operation further includes providing a drill bit to the terminal end of the wellbore and producing drilling spoils at the terminal end of the wellbore, and further wherein performing the second downhole operation further includes removing the drilling spoils from the wellbore.

K5. The method of any of paragraphs K1-K4, wherein the well includes a plurality of operational states, including at least a drilling state, and further wherein, in the drilling state, performing the first downhole operation includes supplying a drilling mud to a terminal end of the wellbore and performing the second downhole operation includes controlling an equivalent circulating density of the drilling mud.

K6. The method of paragraph K5, wherein controlling the equivalent circulating density of the drilling mud includes injecting a fluid with a lower density than the drilling mud into the wellbore.

K7. The method of any of paragraphs K1-K6, wherein the well includes a plurality of operational states, including at least a completing state, and further wherein, in the completing state, performing the first downhole operation includes supplying a sealing material to the wellbore and performing the second downhole operation includes removing a fluid from the wellbore.

K8. The method of any of paragraphs K1-K7, wherein the well includes a plurality of operational states, including at least a stimulating state, and further wherein, in the stimulating state, performing the first downhole operation includes supplying a stimulant fluid to the wellbore and performing the second downhole operation includes controlling a flow rate of at least one of the reservoir fluid and the stimulant fluid from the wellbore.

K9. The method of any of paragraphs K1-K8, wherein the well includes a plurality of operational states, including at least a producing state, and further wherein, in the producing state, performing the first downhole operation includes injecting a pressurizing fluid into the wellbore and performing the second downhole operation includes producing the reservoir fluid from the subterranean formation.

K10. The method of any of paragraphs K1-K9, wherein the well includes a plurality of operational states, including at least an abandoning state, and further wherein, in the abandoning state, at least one of performing the first downhole operation and performing the second downhole operation includes providing a sealing material to the wellbore.

K11. The method of paragraph K10, wherein providing the sealing material to the wellbore includes providing the sealing material to a bottom portion of the casing string.

K12. The method of any of paragraphs K1-K11, wherein the performing the first downhole operation and the performing the second downhole operation are simultaneous.

K13. The method of any of paragraphs K1-K12, wherein the casing string further forms at least a first data pathway, wherein the method includes monitoring a variable associated with the well using the first data pathway, and further wherein the first data pathway is distinct from at least a portion of the plurality of hydraulic pathways.

K14. The method of any of paragraphs K1-K13, wherein the casing string further forms at least a first mechanical access pathway, wherein the method includes inserting a mechanical device into the wellbore using the first mechanical access pathway, and further wherein at least a portion of the first mechanical access pathway is distinct from at least a portion of the plurality of hydraulic pathways.

K15. The method of any of paragraphs K1-K14, wherein the reservoir includes a hydrocarbon reservoir and the reservoir fluid includes a hydrocarbon.

INDUSTRIAL APPLICABILITY

The systems and methods disclosed herein are applicable to the oil and gas industry. It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of operating a well configured to provide a hydraulic connection between a surface region and a subterranean, the well including a casing string contained within a wellbore that extends between the surface region and the subterranean formation, wherein the casing string constitutes a plurality of hydraulic pathways between the surface region and the subterranean formation, the method comprising:

providing the casing string within the wellbore between the surface region and a first portion of the subterranean formation;

providing another tubular conduit within the wellbore between the surface region and a second portion of the subterranean formation, the second portion of the subterranean formation extending within a portion of the subterranean formation not including the casing string;

performing a first downhole operation in the first portion of the subterranean formation, including establishing a first fluid communication between the surface region and the first portion of the subterranean formation using a first hydraulic pathway of the casing string; and performing a second downhole operation in the second portion of the subterranean formation using the another tubular conduit, including establishing a second fluid communication between the surface region and a second portion of the subterranean formation using a second hydraulic pathway of the casing string, wherein the second hydraulic pathway is different from the first hydraulic pathway, the second downhole operation related to drilling the well.

2. The method of claim 1, wherein the well is in fluid communication with a plurality of production control assemblies and the method further includes controlling the first downhole operation with a first production control assembly and controlling the second downhole operation with a second production control assembly, wherein the first production control assembly is different from the second production control assembly.

3. The method of claim 1, wherein the well includes a plurality of operational states, including at least a drilling state, and further wherein, in the drilling state, performing the first downhole operation includes supplying a drilling mud to a terminal end of the wellbore and performing the second downhole operation includes removing the drilling mud from the wellbore.

4. The method of claim 3, wherein performing the first downhole operation further includes providing a drill bit to the terminal end of the wellbore and producing drilling spoils at the terminal end of the wellbore, and further wherein performing the second downhole operation further includes removing the drilling spoils from the wellbore.

5. The method of claim 1, wherein the well includes a plurality of operational states, including at least a drilling state, and further wherein, in the drilling state, performing the first downhole operation includes supplying a drilling mud to the terminal end of the wellbore and performing the second downhole operation includes controlling an equivalent circulating density of the drilling mud.

6. The method of claim 5, wherein controlling the equivalent circulating density of the drilling mud includes injecting a fluid with a lower density than the drilling mud into the wellbore.

7. The method of claim 1, wherein the well includes a plurality of operational states, including at least a completing state, and further wherein, in the completing state, performing the first downhole operation includes supplying a sealing material to the wellbore and performing the second downhole operation includes removing a fluid from the wellbore.

8. The method of claim 1, wherein the well includes a plurality of operational states, including at least a stimulating state, and further wherein, in the stimulating state, performing the first downhole operation includes supplying a stimulant fluid to the wellbore and performing the second downhole operation includes controlling a flow rate of at least one of the reservoir fluid and the stimulant fluid from the wellbore.

9. The method of claim 8, wherein controlling a flow rate of at least one of the reservoir fluid and the stimulant fluid from the wellbore further includes controlling a pressure within the wellbore.

10. The method of claim 1, wherein the well includes a plurality of operational states, including at least a producing state, and further wherein, in the producing state, performing the first downhole operation includes injecting a pressurizing fluid into the wellbore and performing the second downhole operation includes producing the reservoir fluid from the subterranean formation.

11. The method of claim 1, wherein the well includes a plurality of operational states, including at least an abandoning state, and further wherein, in the abandoning state, at least one of performing the first downhole operation and performing the second downhole operation includes providing a sealing material to the wellbore.

12. The method of claim 11, wherein providing the sealing material to the wellbore includes providing the sealing material to a bottom portion of the casing string.

13. The method of claim 1, wherein the performing the first downhole operation and the performing the second downhole operation are simultaneous.

14. The method of claim 1, wherein the casing string includes an outer casing string surface and a plurality of inner casing string surfaces, wherein the casing string constituting the plurality of hydraulic pathways includes the plurality of inner casing string surfaces defining at least a portion of the plurality of hydraulic pathways, including at least a portion of the first hydraulic pathway and at least a portion of the second hydraulic pathway, wherein each of the plurality of inner casing string surfaces is contained within the outer casing string surface, and further wherein the plurality of inner casing string surfaces are separated from at least a portion of the outer casing string surface by a casing string wall.

15. The method of claim 1, wherein the casing string includes a plurality of casing conduits that each includes a longitudinal axis, and further wherein the casing conduits are operatively attached along their respective longitudinal axes to form the casing string.

16. The method of claim 15, wherein at least a portion of the plurality of casing conduits include a monolithic structure that forms at least a portion of the first hydraulic pathway and at least a portion of the second hydraulic pathway.

17. The method of claim 15, wherein at least a portion of the plurality of casing conduits include a composite structure that includes at least two components that are operatively attached to one another to form at least a portion of the first hydraulic pathway and at least a portion of the second hydraulic pathway.

18. The method of claim 15, wherein the plurality of casing conduits includes at least a first casing conduit and at least a second casing conduit, and further wherein the at least a first casing conduit is operatively attached to the at least a second casing conduit at a casing conduit junction, and still further wherein the casing conduit junction includes a manifold.

19. The method of claim 15, wherein the plurality of casing conduits includes at least a first casing conduit and at least a second casing conduit, and further wherein the at least a first casing conduit is operatively attached to the at least a second casing conduit at a casing conduit junction, and still further wherein the casing conduit junction includes a timed connection.

20. The method of claim 1, wherein at least one of the plurality of hydraulic pathways further includes a flow control device, and the method further includes controlling the flow of fluid through the hydraulic pathway with the flow control device.

21. The method of claim 20, wherein the flow control device includes at least one of a permeable membrane, a check valve, an end cap, a mechanical flapper, a disappearing plug, a swellable packoff, and a machined slot.

22. The method of claim 1, wherein the casing string further forms at least a first data pathway, wherein the method includes monitoring a variable associated with the well using the first data pathway, and further wherein the first data pathway is distinct from at least a portion of the plurality of hydraulic pathways.

23. The method of claim 1, wherein the casing string further forms at least a first mechanical access pathway, wherein the method includes inserting a mechanical device into the wellbore using the first mechanical access pathway, and further wherein at least a portion of the first mechanical access pathway is distinct from at least a portion of the plurality of hydraulic pathways.

24. The method of claim 1, wherein at least one of establishing a first fluid communication between the surface region and the first portion of the subterranean formation and establishing a second fluid communication between the surface region and the second portion of the subterranean formation includes communicating with a plurality of depths within the subterranean formation, and further wherein the plurality of depths includes at least a first depth and at least a second depth, and still further wherein the at least a first depth differs from the at least a second depth by at least 5 meters.

25. The method of claim 1, wherein the casing string includes a terminal depth, and further wherein at least one of establishing a first fluid communication between the surface region and the first portion of the subterranean formation and establishing a second fluid communication between the surface region and the second portion of the subterranean formation includes establishing fluid communication with the terminal depth of the casing string formation.

26. The method of claim 1, wherein the reservoir includes a hydrocarbon reservoir and the reservoir fluid includes a hydrocarbon.

27. The method of claim 1, wherein the another tubular conduit comprises at least one of a drill string, a production tubing string, a coiled tubing string, a completion string, a gravel packing string, a stimulation string, a production liner, and an injection string.

28. A wellbore, comprising:

a casing conduit including (i) a basal conduit; and (ii) a plurality of hydraulic pathways including at least a first hydraulic pathway and at least a second hydraulic pathway, wherein at least the first hydraulic pathway and the second hydraulic pathway are adapted to provide hydraulic communication between a first end of the casing conduit and a second end of the casing conduit;

another tubular conduit disposed within the basal conduit and extending beyond the basal conduit, the another conduit extending through at least a portion of the basal conduit and into a portion of the wellbore not including the basal conduit;

wherein the first hydraulic pathway of the casing string is used to perform a first downhole operation in the first portion of the subterranean formation, including establishing a first fluid communication between the surface region and the first portion of the subterranean formation; and wherein the second hydraulic pathway is different from the first hydraulic pathway and wherein the second hydraulic pathway is used to perform a second downhole operation in the second portion of the subterranean formation using the another tubular conduit, including establishing a second fluid communication between the surface region and a second portion of the subterranean formation, wherein the second downhole operation is related to drilling a well.

29. The wellbore of claim 28, wherein the casing conduit includes an outer casing conduit surface and a plurality of inner casing conduit surfaces, wherein the casing conduit constitutes a plurality of hydraulic pathways, wherein the plurality of inner casing conduit surfaces defines least a portion of the plurality of hydraulic pathways, including at least a portion of the first hydraulic pathway and at least a portion of the second hydraulic pathway, and wherein each of the plurality of inner casing conduit surfaces is contained within the outer casing conduit surface, and further wherein the plurality of inner casing conduit surfaces are separate from at least a portion of the outer casing conduit surface by a casing conduit wall.

30. The wellbore of claim 28, wherein at least one of the plurality of hydraulic pathways further includes a flow control device.

31. The wellbore of claim 30, wherein the flow control device includes at least one of a permeable membrane, a check valve, an end cap, a mechanical flapper, a disappearing plug, a swellable packoff, and a machined slot.

32. The wellbore of claim 28, wherein the casing conduit includes a monolithic structure that forms at least a portion of the first hydraulic pathway and at least a portion of the second hydraulic pathway.

33. The wellbore of claim 28, wherein the casing conduit includes a composite structure including at least two components that are operatively attached to one another to form at least a portion of the first hydraulic pathway and at least a portion of the second hydraulic pathway.

34. The wellbore of claim 28, wherein each of the plurality of casing conduits each includes a longitudinal axis, and further wherein the casing conduits are operatively attached along their respective longitudinal axes to form the casing string.

35. The wellbore of claim 34, wherein the plurality of casing conduits includes at least a first casing conduit and at least a second casing conduit, and further wherein the at least a first casing conduit is operatively attached to the at least a second casing conduit at a casing conduit junction, and still further wherein the casing conduit junction includes a manifold.

36. The wellbore of claim 34, wherein the plurality of casing conduits includes at least a first casing conduit and at least a second casing conduit, and further wherein the at least a first casing conduit is operatively attached to the at least a second casing conduit at a casing conduit junction, and still further wherein the casing conduit junction includes a timed connection.

37. The wellbore of claim 34, further comprising an oil well including at least the first casing string configured to provide a hydraulic connection between a surface region and a subterranean formation that includes a reservoir, the oil well being adapted to produce a reservoir fluid from the reservoir and having the first casing string contained within a wellbore that extends between the surface region and the subterranean formation.

38. The wellbore of claim 37, further comprising an oil well including, wherein the oil well further includes at least a first mechanical access pathway formed by the casing string and adapted to provide access to the subterranean formation for a mechanical device, and further wherein the at least a first mechanical access pathway is distinct from the plurality of hydraulic pathways.

39. The wellbore of claim 37, further comprising an oil well including oil well of claim 37, wherein the oil well further includes a plurality of production control assemblies that includes at least a first production control assembly in fluid communication with at least a first hydraulic pathway and at least a second production control assembly in fluid communication with at least a second hydraulic pathway, wherein the first production control assembly is different from the second production control assembly and the first hydraulic pathway is different from the second hydraulic pathway.

40. The wellbore of claim 34, further comprising an oil well including at least a first data pathway formed by the casing string and adapted to provide a data connection between the surface region and a portion of the subterranean formation, and further wherein the at least a first data pathway is distinct from the plurality of hydraulic pathways.

41. The wellbore of claim 28, wherein the another tubular conduit comprises at least one of a drill string, a production tubing string, a coiled tubing string, a completion string, a gravel packing string, a stimulation string, a production liner, and an injection string.

* * * * *